US009578920B2

(12) United States Patent
Grott et al.

(10) Patent No.: US 9,578,920 B2
(45) Date of Patent: Feb. 28, 2017

(54) ENERGY RETURN, CUSHIONING, AND ARCH SUPPORT PLATES, AND FOOTWEAR AND FOOTWEAR SOLES INCLUDING THE SAME

(71) Applicant: Ariat International, Inc., Union City, CA (US)

(72) Inventors: Marco Aurelio Grott, Pleasanton, CA (US); Calvin Myron Buck, IV, Vancouver, WA (US)

(73) Assignee: Ariat International, Inc., Union City, CA (US)

( * ) Notice: Subject to any disclaimer, the term of this patent is extended or adjusted under 35 U.S.C. 154(b) by 0 days.

(21) Appl. No.: 14/710,381

(22) Filed: May 12, 2015

(65) Prior Publication Data

US 2015/0327624 A1 Nov. 19, 2015

Related U.S. Application Data

(60) Provisional application No. 61/992,846, filed on May 13, 2014.

(51) Int. Cl.
*A43B 7/14* (2006.01)
*A43B 1/00* (2006.01)
(Continued)

(52) U.S. Cl.
CPC ..... *A43B 7/14* (2013.01); *A43B 1/0072* (2013.01); *A43B 3/0057* (2013.01); *A43B 7/142* (2013.01);
(Continued)

(58) Field of Classification Search
CPC ..... A43B 7/14; A43B 13/186; A43B 13/42
(Continued)

(56) References Cited

U.S. PATENT DOCUMENTS 1,387,411 A 8/1921 Kolkebeck
D98,150 S 1/1936 Drake
(Continued)

FOREIGN PATENT DOCUMENTS

CN 102309088 B 7/2013
EP 0887029 A2 12/1998
(Continued)

OTHER PUBLICATIONS

English-language abstract of Chinese Patent Publication No. CN 102309088 B, European Patent Office, Jul. 17, 2013.
(Continued)

*Primary Examiner* — Anna Kinsaul
*Assistant Examiner* — Heather Mangine
(74) *Attorney, Agent, or Firm* — DASCENZO Intellectual Property Law, P.C.

(57) ABSTRACT

Support plates, and footwear soles and articles of footwear containing the same. The support plate generally may provide one or more of heel cushioning, arch support in a midfoot region of the support plate, and integral medial and lateral legs extending from the midfoot region of the support plate towards an anterior end of the support plate. An article of footwear may include a support plate at least partially embedded within a sole assembly, such as a midsole thereof. The support plate may be configured to provide energy return and arch support to a wearer of the article of footwear. The support plate may include a domed structure with radially extending arms extending from a central heel portion, where the domed structure provides heel cushioning to the wearer when a force is transmitted through the midsole to the domed structure.

49 Claims, 13 Drawing Sheets

(51) Int. Cl.

| | |
|---|---|
| ***A43B 3/00*** | (2006.01) |
| ***A43B 13/02*** | (2006.01) |
| ***A43B 13/12*** | (2006.01) |
| ***A43B 13/18*** | (2006.01) |
| ***A43B 13/42*** | (2006.01) |

(52) U.S. Cl.
CPC ..... *A43B 7/144* (2013.01); *A43B 7/1445* (2013.01); *A43B 13/026* (2013.01); *A43B 13/125* (2013.01); *A43B 13/183* (2013.01); *A43B 13/184* (2013.01); *A43B 13/186* (2013.01); *A43B 13/188* (2013.01); *A43B 13/42* (2013.01)

(58) Field of Classification Search
USPC ... 36/91, 107, 108, 140–150, 155, 160, 162, 36/173–176
See application file for complete search history.

(56) References Cited

U.S. PATENT DOCUMENTS

| | | | | |
|---|---|---|---|---|
| 2,132,523 | A | 10/1938 | Berry | |
| 2,483,525 | A | 10/1949 | Brust | |
| 2,487,227 | A | 11/1949 | Eberle | |
| 2,536,723 | A | 1/1951 | Carpenter | |
| 2,994,972 | A | 8/1961 | Blair | |
| 3,546,796 | A | 12/1970 | Adams | |
| 4,200,998 | A | 5/1980 | Adams | |
| 4,255,876 | A | 3/1981 | Johnson | |
| 4,451,995 | A | 6/1984 | Antonious | |
| 4,622,763 | A | 11/1986 | Adams | |
| 4,766,679 | A | 8/1988 | Bender | |
| 4,843,737 | A | 7/1989 | Vorderer | |
| 4,858,338 | A | 8/1989 | Schmid | |
| 4,899,466 | A | 2/1990 | Skaja | |
| 5,052,130 | A | 10/1991 | Barry et al. | |
| 5,191,727 | A | 3/1993 | Barry et al. | |
| 5,572,805 | A | 11/1996 | Giese et al. | |
| 5,797,200 | A | 8/1998 | Hess et al. | |
| 6,199,303 | B1 | 3/2001 | Luthi et al. | |
| 6,237,255 | B1 | 5/2001 | Renaudin et al. | |
| 6,282,814 | B1 | 9/2001 | Krafsur et al. | |
| 6,393,731 | B1 | 5/2002 | Moua et al. | |
| 6,449,878 | B1 | 9/2002 | Lyden | |
| 6,477,791 | B2 | 11/2002 | Luthi et al. | |
| 6,497,057 | B1 | 12/2002 | Lee et al. | |
| 6,502,330 | B1 | 1/2003 | David et al. | |
| 6,775,930 | B2 * | 8/2004 | Fuerst | A43B 13/026 12/146 B |
| 6,954,998 | B1 | 10/2005 | Lussier | |
| 7,096,605 | B1 | 8/2006 | Kozo et al. | |
| 7,100,308 | B2 | 9/2006 | Aveni | |
| 7,181,868 | B2 | 2/2007 | Auger et al. | |
| 7,204,042 | B2 | 4/2007 | Aveni | |
| 7,434,337 | B2 | 10/2008 | Gibert et al. | |
| 7,464,489 | B2 | 12/2008 | Ho | |
| 7,770,308 | B2 | 8/2010 | Leoncini | |
| 7,886,460 | B2 | 2/2011 | Teteriatnikov et al. | |
| 7,900,377 | B1 | 3/2011 | Perenich | |
| 7,905,033 | B1 | 3/2011 | Perenich | |
| 7,913,422 | B1 | 3/2011 | Perenich | |
| 7,921,580 | B2 | 4/2011 | Russell | |
| 8,186,081 | B2 | 5/2012 | Wilson, III et al. | |
| 8,341,856 | B2 | 1/2013 | Smith et al. | |
| 8,365,440 | B2 | 2/2013 | Rivas et al. | |
| 8,510,970 | B2 | 8/2013 | Baum et al. | |
| 8,776,397 | B2 | 7/2014 | Borel et al. | |
| 8,984,775 | B2 | 3/2015 | Dombrow et al. | |
| 2001/0007177 | A1 | 7/2001 | Brown, Jr. et al. | |
| 2002/0069558 | A1 | 6/2002 | Wilkinson | |
| 2002/0116842 | A1 | 8/2002 | Meschan | |
| 2002/0174567 | A1 | 11/2002 | Krafsur et al. | |
| 2004/0000074 | A1 | 1/2004 | Auger et al. | |
| 2005/0108897 | A1 | 5/2005 | Aveni | |
| 2005/0241187 | A1 * | 11/2005 | Johnson | A43B 3/0063 36/103 |
| 2005/0246922 | A1 | 11/2005 | Gibert et al. | |
| 2006/0156580 | A1 | 7/2006 | Russell | |
| 2006/0162190 | A1 | 7/2006 | Nishiwaki et al. | |
| 2006/0174515 | A1 | 8/2006 | Wilkinson | |
| 2006/0174520 | A1 | 8/2006 | Wu | |
| 2007/0062065 | A1 | 3/2007 | Wang et al. | |
| 2007/0144037 | A1 | 6/2007 | Russell | |
| 2008/0078103 | A1 | 4/2008 | Liles | |
| 2008/0250668 | A1 | 10/2008 | Marvin et al. | |
| 2008/0289220 | A1 | 11/2008 | Rivas et al. | |
| 2009/0014424 | A1 | 1/2009 | Meschter | |
| 2009/0019730 | A1 * | 1/2009 | Salminen | A43B 7/1425 36/91 |
| 2009/0064536 | A1 * | 3/2009 | Klassen | A43B 13/181 36/27 |
| 2009/0139114 | A1 * | 6/2009 | Malek | A43B 7/144 36/3 B |
| 2009/0178303 | A1 | 7/2009 | Hurd et al. | |
| 2009/0217551 | A1 | 9/2009 | Shirokikh | |
| 2009/0320330 | A1 | 12/2009 | Borel et al. | |
| 2010/0293816 | A1 | 11/2010 | Truelsen | |
| 2010/0307025 | A1 | 12/2010 | Truelsen et al. | |
| 2011/0047816 | A1 | 3/2011 | Nurse | |
| 2012/0030971 | A9 | 2/2012 | Truelsen | |
| 2012/0174432 | A1 | 7/2012 | Peyton | |
| 2013/0061495 | A1 | 3/2013 | Lubart | |
| 2013/0219752 | A1 | 8/2013 | Dombrow et al. | |
| 2014/0059887 | A1 * | 3/2014 | Lawlor | A43B 3/26 36/83 |
| 2014/0075779 | A1 * | 3/2014 | Bruce | A43B 13/20 36/29 |
| 2015/0047224 | A1 * | 2/2015 | Zhao | A43B 13/223 36/84 |

FOREIGN PATENT DOCUMENTS

| | | | |
|---|---|---|---|
| EP | 1882421 | A2 | 1/2008 |
| WO | WO 03/015559 | A1 | 2/2003 |

OTHER PUBLICATIONS

English machine-language translation of Chinese Patent Publication No. CN 102309088 B, Jul. 17, 2013.

* cited by examiner

ENERGY RETURN, CUSHIONING, AND ARCH SUPPORT PLATES, AND FOOTWEAR AND FOOTWEAR SOLES INCLUDING THE SAME

RELATED APPLICATION

This application claims priority under 35 U.S.C. § 119(e) to U.S. Provisional Patent Application No. 61/992,846, which was filed May 13, 2014, and the complete disclosure of which is hereby incorporated by reference.

FIELD

The present disclosure relates to support plates for footwear, and to footwear and footwear soles including such support plates.

BACKGROUND

An article of footwear may include a sole and an upper that form a cavity, or foot compartment, in which a wearer places his or her foot when the article of footwear is donned and worn. The sole of the footwear engages the bottom of the wearer's foot and separates the foot from the ground. The sole often consists of one or more layers of materials, including leather, rubber, foam, and/or plastics that provide shock absorption and support to the wearer's foot. The upper extends outwardly from an outer periphery of the sole and covers at least a portion of the foot.

Footwear such as dress shoes, athletic footwear, work boots, hiking boots, and others are worn for a variety of applications which require a significant workload in terms of duration of wear or impact. Such footwear, particularly heeled footwear, includes a rigid shank that extends from a heel region of the sole assembly to the forefoot region of the sole assembly. Such a conventional shank is typically secured to an outsole portion of the footwear and sole, above which a midsole portion and/or footbed are positioned. The sole assembly and shank may provide for limited padding or shock absorption in the course of a wearer's gait.

During walking or running, the human foot transfers energy (e.g., in the form of force from the shock impact of the wearer's foot striking the ground with the sole between the foot and the ground) into the sole and further to the ground through the sole. A substantial portion of this energy is lost to the wearer, such as by being disbursed into the material of the sole at the area of contact. A portion of the energy that is not lost is returned into the foot of the wearer, but generally not in an advantageous manner. For example, some of the energy may be reflected back into the foot at the point of impact, which may cause discomfort, and potentially injury.

SUMMARY

Presently disclosed articles of footwear may include a support plate at least partially embedded within a sole assembly of the article of footwear, where the support plate may generally provide heel cushioning, arch support in a midfoot region of the support plate, and energy return to the foot of the wearer of the article of footwear. The support plate may include medial and lateral legs extending from the midfoot region of the support plate. The medial and lateral legs may be configured to provide energy return to the foot of the wearer of the article of footwear. For example, an article of footwear according to the present disclosure may include an upper configured to engage with a wearer's foot when the footwear is worn, a sole assembly coupled to the upper, and the support plate at least partially embedded within the sole assembly. The sole assembly may include a midsole and an outsole, the outsole having an outer surface that is configured to engage with a surface on which the wearer is striding or standing. The outsole may be engaged with the midsole of the sole assembly.

The support plate may include an upper surface extending from a posterior end of the support plate to an anterior end of the support plate, a lower surface opposite the upper surface, a cushioning heel portion adjacent the posterior end of the support plate, a midfoot portion formed integrally with the cushioning heel portion, a medial leg formed integrally with the cushioning heel portion and the midfoot portion, and a lateral leg formed integrally with the cushioning heel portion and the midfoot portion. The midfoot portion may form an arch support portion that is curved to conform to an arch portion of the wearer's foot. The medial leg and the lateral leg each may extend longitudinally from the midfoot portion towards the anterior end of the support plate. The cushioning heel portion may include a domed structure, which may include a plurality of radially extending arms that extend from a central heel portion of the support plate.

DESCRIPTION

Figure 1:
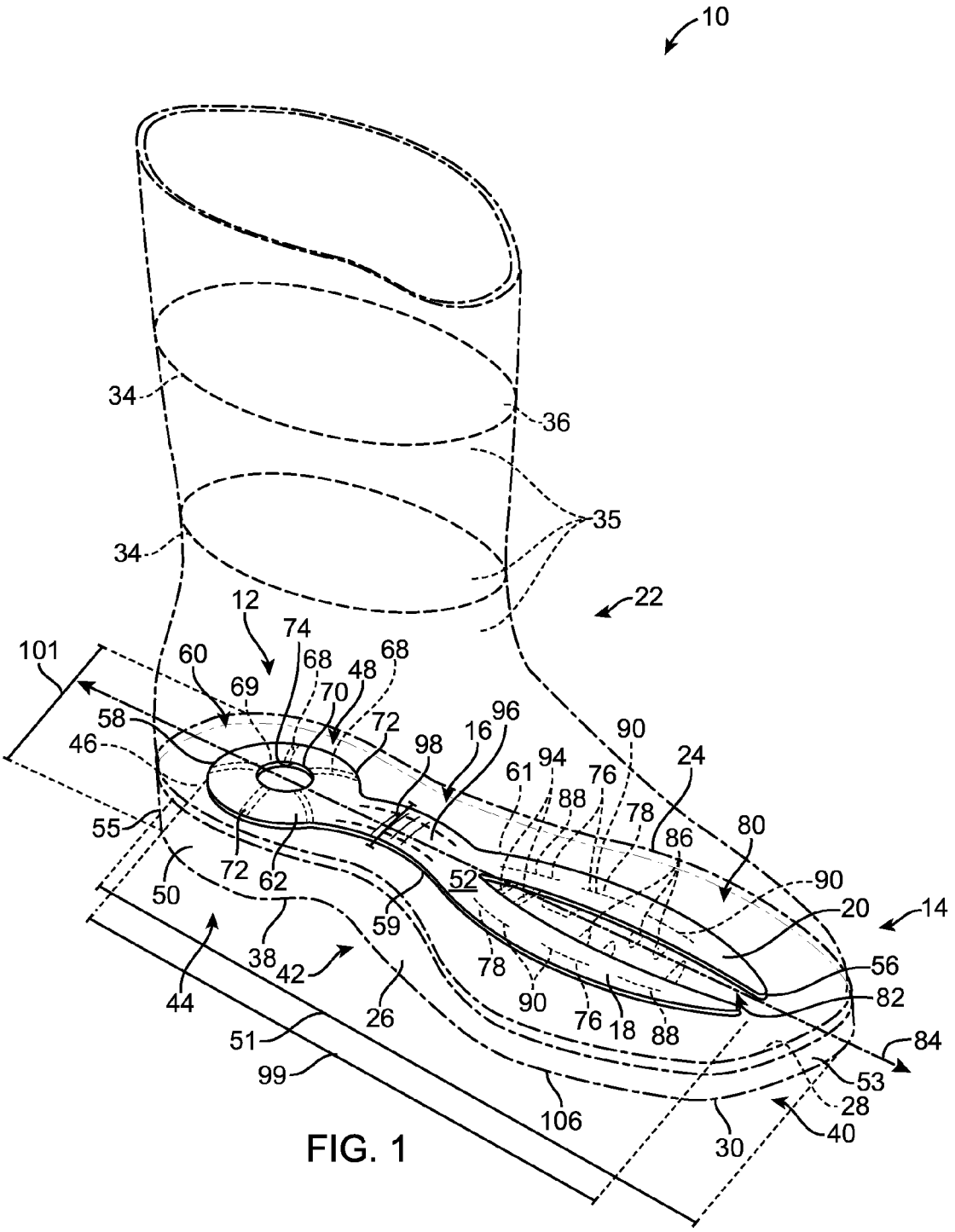
FIG. 1 is a schematic representation of examples of articles of footwear according to the present disclosure, shown in a perspective view.

FIGS. 1-13 provide examples of support plates 12, and sole assemblies 14 and articles of footwear 10 that include support plates 12. Elements that serve a similar, or at least substantially similar, purpose are labeled with like numbers in each of FIGS. 1-13, and these elements may not be discussed in detail herein with reference to each of FIGS. 1-13. Similarly, all elements may not be labeled in each of FIGS. 1-13, but reference numerals associated therewith may be utilized herein for consistency. Elements, components, and/or features that are discussed herein with reference to one or more of FIGS. 1-13 may be included in and/or utilized with any of FIGS. 1-13 without departing from the scope of the present disclosure.

Figure 2:
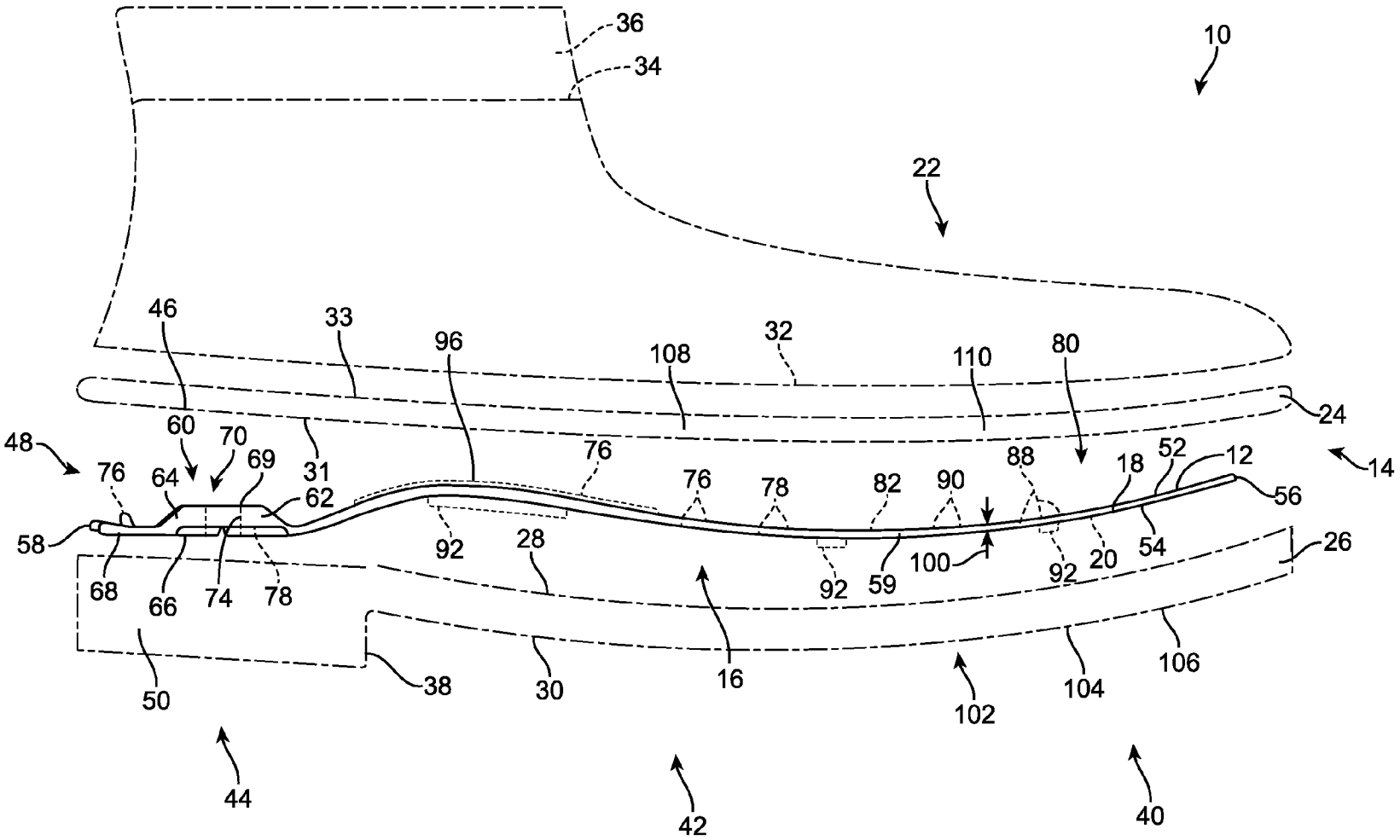
FIG. 2 is a schematic representation of examples of articles of footwear according to the present disclosure, shown in an exploded, side elevation view.

Generally, support plate 12 may be configured to provide energy return, cushioning, arch support, and/or torsional stability to a wearer of article of footwear 10. As schematically indicated in FIGS. 1-2, support plate 12 may include a heel region 44 that is configured to provide heel cushioning to the heel of the wearer's foot, arch support in a midfoot region 16 of support plate 12, and a forefoot region 80 that is configured to provide energy return to the foot of the wearer of the article of footwear. Midfoot region 16 of support plate 12 additionally or alternatively may be referred to as an arch support region 16 or a midfoot portion 16 of support plate 12. Forefoot region 80 may include a medial leg 18 (which also may be referred to as a medial spring leg 18) and a lateral leg 20 (which also may be referred to as a lateral spring leg 20) extending from midfoot region 16 of support plate 12. Medial leg 18 and lateral leg 20 may be formed integrally with midfoot region 16 of support plate 12, and optionally may be described as extending from within the midfoot region toward the anterior end of the support plate.

The medial leg and lateral leg may provide energy return to the wearer's foot, such as to the forefoot regions of the wearer's foot.

As schematically represented in FIGS. 1-2, support plate 12 may be at least partially embedded within or otherwise secured to and/or within a sole assembly 14 of article of footwear 10. Sole assembly 14 may include at least a midsole 24 and an outsole 26. Generally, midsole 24 may be positioned above outsole 26, such that midsole 24 is between the wearer's foot and outsole 26, while outsole 26 may engage the ground or other surface on which the wearer is standing, striding, walking, running, jumping, or otherwise wearing article of footwear 10. An outer surface 30 of outsole 26, opposite inner surface 28, may be configured to engage the ground or other surface on which the wearer is standing, walking, etc. while wearing the article of footwear 10. In contrast, inner surface 28 of outsole 26 may be configured to engage midsole 24 (e.g., a bottom midsole surface 31 of midsole 24, which may be arranged opposite a top midsole surface 33, as indicated in FIG. 2) and/or support plate 12.

As schematically illustrated in FIG. 2, outsole 26 may include a tread region 102 in at least an outsole forefoot region 104 (e.g., corresponding generally to forefoot region of sole assembly 14). Tread region 102 may be a region of a ground-contacting surface 106 (which may correspond with or be a portion of outer surface 30 of outsole 26) of article of footwear 10 that may include a distinct tread structure, such as including a non-smooth surface, and in some embodiments including tread projections, tread channels or cavities, and the like. Some examples of articles of footwear 10 may not include tread region 102, such that all of ground-contacting surface 106 of article of footwear 10 may be substantially smooth. Other configurations are also within the scope of the present disclosure, and regardless of the presence of tread region 102, outsole 26 may be described as having outsole forefoot region 104 that includes at least ground-contacting surface 106. Examples of suitable materials for construction of ground-contacting surface 106, including tread region 102, of article of footwear 10 according to the present disclosure include (but are not limited to) one or more of polymers, elastomers, polyurethanes, leathers, synthetic rubbers, and such injection-moldable polymers as thermo polyurethanes, thermo poly rubbers, and thermo rubbers.

Sole assembly 14 may include one or more additional layers, such as an insole, or footbed, 32 that is configured to engage an underside of the wearer's foot and top midsole surface 33. Furthermore, each of the outsole, midsole, and footbed may individually include one or more layers, components, features, materials of construction, etc. without departing from the scope of the present disclosure.

Different areas of sole assembly 14 may be formed of different materials, and/or different areas of sole assembly 14 may have different compliance than other areas of sole assembly 14. For example, heel region 46 of midsole 24 may have a different compliance than other areas of midsole 24 (e.g., a midsole midfoot region 108 corresponding to midfoot region 42 and/or a midsole forefoot region 110 corresponding to forefoot region 40 of sole assembly 14). For example, midsole heel region 46 may be formed of a more compliant material than midsole midfoot region 108 and/or midsole forefoot region 110. In some examples, midsole heel region 46 may include a compliant material, such as a gel and/or a foam material. Generally, midsole heel region 46 may be formed of any material that may transmit at least some of the impact forces from a wearer to heel portion 48 of support plate 12. Heel portion 48 of support plate 12 may be at least partially embedded within midsole heel region 46.

Generally, midsole 24 may be arranged above outsole 26 within article of footwear 10, with upper 22 coupled to sole assembly 14, and support plate 12 being arranged generally below and/or at least partially embedded within midsole 24. A lower (ground-facing) surface of the support plate may be coplanar with the lower surface of the midsole, although this is not required to all support plates 12. Portions of support plate 12 may extend into and/or through outsole 26. Sole assembly 14 may further include at least one of a liner, an insole, and/or a footbed positioned above midsole 24. As used herein, the terms "upper," "above," "top," "lower," "bottom," and similar terms as used to describe spatial relationships between components of footwear and/or between a component of footwear and a ground, surface, or other object, are considered from the perspective of footwear positioned in an upright orientation on a level ground surface. Accordingly, an upper surface, or upper side, (e.g., upper surface 52 of support plate 12) refers to a surface or a side of a component that generally faces away from the ground surface, while a lower surface, or lower side, (e.g., lower surface 54 of support plate 12) refers to a surface or side that generally faces toward the ground surface.

The terms "medial" and "medial side" refer to the inner side of a foot extending from the hallux to the heel, and the terms "lateral" and "lateral side" refer to the outer side of the foot extending from the small toe to the heel. Similarly, articles of footwear include medial and lateral sides that conform to the medial and lateral sides, respectively, of the foot. As described herein, the heel region is considered to be the posterior end of the foot and the portion of an article of footwear that engages the heel is the posterior end of the article of footwear. Conversely, the forefoot region, which includes the toe-end of an article of footwear, is considered to be the anterior end of an article of footwear. As used herein, the centerline of a footwear component refers to the primary axis of length along the center of the article of footwear.

Support plate 12 may be incorporated within sole assembly 14, such as by being at least partially embedded within or extending through at least a portion of midsole 24 and/or outsole 26, and/or generally, at least partially, positioned between midsole 24 and outsole 26, such as adjacent an inner (upper) surface 28 of outsole 26. Thus, being at least partially embedded within the midsole or outsole does not require that the support plate be encapsulated or otherwise fully contained within either the midsole or outsole, although such a construction is still within the scope of the present disclosure. In some embodiments, the support plate may be embedded within the lower surface of the midsole, such as to be coextensive therewith, although it is within the scope of the present disclosure that a portion of the support plate, including the lower surface thereof, may extend into the outsole, such as to a recess or other appropriately sized region thereof. In some examples, support plate 12 may be fabricated as a co-molded assembly, such that sole assembly 14 may be formed with support plate 12 and midsole 24 already aligned in an operational configuration. In other examples, midsole 24 and support plate 12 may be fabricated separately, and subsequently aligned and adhered (or otherwise coupled) to each other. Outsole 26 may be molded to fit around and accommodate support plate 12, such that the components may engage with each other, align with each other, and/or conform to each other to form sole assembly 14. For example, support plate 12 may be injected into a mold, and the remainder of sole assembly 14 may be manufactured or fabricated around support plate 12. In other examples, sole assembly 14 may be formed, and materials for support plate 12 may be injected into a cavity formed in the sole assembly, the cavity being configured to receive support plate 12.

In some examples, the entire support plate 12 (which also may be referred to as an energy-return cushion and arch support plate 12) may be positioned with respect to sole assembly 14 such that at least a portion of support plate 12 is covered by outsole 26, such that it is not visible from outer surface 30 of outsole 26. In some examples, a portion of support plate 12 may be visible when looking at outer surface 30 of outsole 26. For example, a portion of support plate 12 may extend at least partially through outsole 26 (e.g., from inner surface 28 towards outer surface 30), and/or portions of outsole 26 may be covered with transparent material and/or open such that support plate 12 may be visible therethrough. In some examples, a portion of support plate 12 may extend through outsole 26, such as from inner surface 28 to outer surface 30, such that portions of support plate 12 may be flush with portions of outsole 26 and/or may contact the ground on which the wearer is using article of footwear 10. An article of footwear 10 according to the present disclosure further includes an upper 22 coupled to sole assembly 14, such as to a periphery thereof, and which extends around at least a portion of the wearer's foot when the article of footwear is worn. For example, upper 22 may engage and/or extend around the toe, vamp, and/or heel of the wearer's foot. Thus, upper 22 and sole assembly 14 may be described as defining a footwear cavity, or foot compartment, into which a wearer's foot is inserted and supported when the article of footwear is donned and worn. References herein to the wearer's foot contacting or being contacted by portions of sole assembly 14 and/or upper 22 do not require direct physical contact, as a wearer often will include a sock. Alternatively, references herein to the wearer's foot additionally or alternatively may refer to the wearer's foot and any sock, stocking, athletic wrap, or other layer that extends around the wearer's foot prior to insertion of the wearer's foot into the footwear's foot compartment.

Upper 22 may be described as including and/or being a shell of the footwear, and in the case of footwear in the form of boots, also may be described as including a shaft 36 that extends along the wearer's leg, such as above an Achilles region of the wearer's leg. Although only schematically illustrated in FIGS. 1 and 2, it is within the scope of the present disclosure that upper 22 may include, or alternatively be free from, one or more adjustable mechanical fasteners to selectively constrain or otherwise reduce the size of the footwear's upper. Examples of such mechanical fasteners include laces, snaps, buckles, and hook-and-loop fasteners.

Footwear 10 according to the present disclosure may include shoes and boots, such as dress shoes, casual shoes, athletic footwear, work boots, hiking boots, riding boots, cowboy boots, military footwear, construction industry footwear, recreational shoes, lightweight boots, and/or outdoor boots/shoes. As indicated in dashed lines at 34, article of footwear 10 may be a shoe or a low-cut boot, a high-top shoe or a mid-cut boot, and/or may include a shaft 36 that extends upward along a portion of the wearer's leg, such as may be the case with certain boots, such as riding and cowboy boots. Article of footwear 10 may include a projecting heel 38 that may project downward from outer surface 30 of outsole 26. When present, projecting heel 38 may be an integral portion of outsole 26 or may be a separate component that is nailed, adhered, or otherwise secured to the heel region of the outsole.

As discussed herein, components of footwear 10, such as components of support plate 12 and/or sole assembly 14, may be described in terms of relative positions with respect to article of footwear 10 and/or the wearer's foot upon which the article of footwear is worn. For example, sole assembly 14 and its component parts (e.g., midsole 24, outsole 26, etc.) may be described in relation to and/or as including a forefoot region 40, an arch (or midfoot) region 42, and a heel region 44 (or rear region 44 or rear portion 44) of sole assembly 14, with arch region 42 extending between forefoot region 40 and heel region 44. These regions may be generally positioned underneath the corresponding forefoot, arch (or midfoot), and heel regions of a wearer's foot, respectively, when article of footwear 10 is being worn by the wearer.

For example, a midsole heel region 46 of midsole 24 may be positioned above a heel portion 48 of support plate 12, such that heel portion 48 of support plate 12 is positioned between midsole heel region 46 and outsole 26 (e.g., an outsole heel region 50). Heel region 44 of sole assembly 14 (e.g., heel portion 48 of support plate 12, midsole heel region 46, and outsole heel region 50) generally may be positioned under the wearer's heel. Midfoot region 42 of sole assembly 14, including midfoot portion 16 of support plate 12 generally may be positioned under the wearer's midfoot, or arch, of the wearer's foot. Forefoot region 40 of sole assembly 14, which may include medial leg 18 and lateral leg 20 of support plate 12, generally may be positioned under the wearer's forefoot (e.g., the portion of the wearer's foot anterior to the arch, which may include the ball of the wearer's foot and/or the toes of the wearer's foot).

In some examples, support plate 12 may extend along substantially an entire length 51 of article of footwear 10, the length 51 of article of footwear 10 extending from the front to the back of article of footwear 10 (e.g., from an anterior footwear end 53 to a posterior footwear end 55). In other examples, support plate 12 may extend along just a portion of the length 51 of article of footwear 10. For example, support plate 12 may extend along at least 50%, at least 60%, at least 70%, at least 80%, and/or at least 90% of the length 51 of article of footwear 10.

The structural components of support plate 12 (e.g., heel portion 48, midfoot portion 16, medial leg 18, and lateral leg 20) may be configured to operate in a coordinated manner in response to a walking gait of a wearer of article of footwear 10. As used herein, the term "gait" refers to the natural progression of the feet of the wearer who is walking or running while wearing footwear 10. For example, upon a heel strike, a portion of support plate 12 may flex (e.g., heel portion 48 and/or midfoot portion 16), and at least partially absorb and disperse the shock force of impact through sole assembly 14, particularly outsole 26. The flexing, absorption of force, and dispersal of force may be augmented by the configuration of heel portion 48. At this point in a walking gait, support plate 12 (e.g., heel portion 48 and/or midfoot portion 16) may deform and operate to settle the foot in a balanced position, which may reduce twisting and faltering, thereby facilitating proper body alignment and forward momentum. As the natural walking gait progresses, due to the resilience and/or coefficient of restitution of support plate 12, heel portion 48 and/or midfoot portion 16 may spring back into their respective default unstressed orientations, where returning to their default unstressed orientations may aid in making the walking gait easier by returning energy towards the heel of the wearer, pushing or otherwise urging the wearer's foot (and thus the wearer) forward and/or upward away from the ground.

Similarly, the force and shock impact from the forefoot of the wearer may be received along medial leg 18 and lateral leg 20 such that medial leg 18 and lateral leg 20 may flex and may at least partly absorb and disperse the shock force through sole assembly 14 (e.g., outsole 26). Flexing, absorption of force, and dispersal of force may be customized or optimized by design features of medial leg 18 and lateral leg 20, such as their thickness, width, length, material, density, compliance, as well as reinforcing elements and/or flexibility elements formed therein and/or thereon, as will be discussed in further detail below. At this point in a walking gait, support plate 12 (e.g., medial leg 18 and/or lateral leg 20) may deform and operate to settle the foot in a balanced position, which may reduce twisting and faltering, thereby facilitating proper body alignment and forward momentum. As the natural walking gait progresses, due to the resilience and coefficient of restitution of support plate 12, medial leg 18 and lateral leg 20 may spring back into their respective default unstressed orientations, where returning to the default unstressed orientations may aid in making the walking gait easier by returning energy towards the forefoot of the wearer, pushing or otherwise urging the wearer's foot forward and/or upward.

Thus, examples of support plate 12 described herein may be structured and engineered to resiliently deform. Support plates 12 may replace traditional midfoot shanks or insole boards in a sole assembly, may add cushioning to the heel area of a footwear directly under the fatty pad of a heel, and/or may establish an energy return opportunity related to the natural transition of the walking gait and related directional forces, without interfering with the wearer's natural gait. In other words, sole assemblies 14 that include support plate 12 may be manufactured without a shank or insole board. Unlike many conventional plates and shanks, support plate 12 may be applied to the bottom of midsole 24, which may ensure that there is cushioning from midsole 24 while also enabling support plate 12 to be closer to the ground or surface on which the article of footwear 10 is being used than orthotic inserts and other supports that rest on top of the midsole and/or footbed of footwear 10.

With reference to FIGS. 1-2, support plate 12 may generally have an upper surface 52 and a lower surface 54 opposite upper surface 52. The upper and lower surfaces each extend longitudinally from an anterior end 56 of support plate 12 to an opposite, posterior, end 58 of support plate 12. Upper surface 52 and lower surface 54 may extend laterally from a medial edge 59 of support plate 12 to an opposite, lateral, edge 61 of support plate 12. As incorporated in sole assembly 14 and article of footwear 10, anterior end 56 of support plate 12 may be positioned to underlie the forefoot of a wearer's foot when article of footwear 10 is worn, posterior end 58 may be positioned to underlie a heel region of the wearer's foot, medial edge 59 may be positioned to underlie a portion of the wearer's foot adjacent the foot's medial edge, and lateral edge 61 may be positioned to underlie a portion of the wearer's foot adjacent the foot's lateral edge. As used herein, elements that are described as being opposite additionally or alternatively may be described as being opposing, generally opposing, oppositely facing and/or distal, with opposite elements not being required to be symmetrical or mirror images of each other.

Heel portion 48 of support plate 12 may be generally adjacent posterior end 58 of support plate 12, and midfoot portion 16 of support plate 12 may be formed integrally with heel portion 48, with medial leg 18 and lateral leg 20 extending from midfoot portion 16 towards anterior end 56. Medial leg 18 and lateral leg 20 may generally be positioned in forefoot region 40 of sole assembly 14.

When incorporated with sole assembly 14, upper surface 52 of support plate 12 may be positioned with respect to article of footwear 10 such that upper surface 52 faces the underside (e.g., bottom) of the wearer's foot when article of footwear 10 is worn as intended, while lower surface 54 of support plate 12 may face the surface or ground on which the wearer is standing, walking, or otherwise supported.

Heel portion 48 of support plate 12 may provide cushioning to at least the heel of the wearer's foot, and thus may be described as being a cushioning heel portion 60 (which is an example of heel portion 48). In some examples, heel portion 48 (e.g., cushioning heel portion 60) may include a domed structure 62 (which also may be referred to as a heel support dome 62). Dome structure 62 may have any suitable (generally) spherical shape, such as a generally hemispherical shape or cap portion thereof. Therefore, and as used herein, "hemisphere" and "hemispherical" may include caps or sections of a hemisphere or hemispherical shape, as well as elliptical, oval, and similar variants thereof.

Domed structure 62 may have a convex surface 64 and a concave surface 66. Convex surface 64 may correspond with upper surface 52 of support plate 12, while concave surface 66 may correspond with lower surface 54 of support plate 12. Domed structure 62 may receive the primary shock impact from a heel of the wearer's foot during a walking gait of the wearer. For example, domed structure 62 may be oriented such that a heel strike by a wearer of article of footwear 10 exerts a force on convex surface 64 of domed structure 62. Such force may be exerted on domed structure 62 through another component of sole assembly 14 (e.g., through midsole 24), such that the wearer's foot may not directly impact domed structure 62 in some examples, but may still impart an impact force to domed structure 62 via the wearer's gait. In some examples, convex surface 64 of domed structure 62 may resiliently compress upon exertion of the force on convex surface 64.

In some examples, upper surface 52 of heel portion 48 (e.g., convex surface 64) may be discontinuous. For example, domed structure 62 may not be a complete hemispherical dome, but may terminate to form a circumferential ridge 69 that may serve as the primary surface of shock reception from the heel of the wearer. In other examples, domed structure 62 may be a complete hemisphere.

Shock impacts received by heel portion 48 may be transferred to a plurality of radially extending arms 68 (which also may be referred to as flex arms 68) extending from heel portion 48, such as extending from a central heel region 70 of heel portion 48, which may be positioned at or near the center of heel portion 48. Each radially extending arm 68 may extend radially outward from central heel region 70 towards a respective peripheral end 72 of the radially extending arm (e.g., towards the perimeter of article of footwear 10). Support plate 12 may include any number of radially extending arms 68, such as at least two, at least three, at least four, at least five, at least six, at least seven, at least eight, at least nine, and/or at least ten radially extending arms 68. The radially extending arms 68 may have the same or different lengths.

Central heel region 70 may include a through-hole 74 extending from upper surface 52 to lower surface 54 of support plate 12, where through-hole 74 may correspond to circumferential ridge 69 of domed structure 62. Circumferential ridge 69, when present, may be molded to be corrugated, tiered, folded, or otherwise shaped to distribute energy from shock impact in alternative manners or directions. Circumferential ridge 69 may be defined by a single, generally circular edge, or may be defined by multiple edges or structure portions of heel portion 48 (e.g., radially extending arms 68). Similarly, radially extending arms 68 may be corrugated, tiered, folded, undulating, and/or otherwise shaped to distribute energy from shock impacts in alternative manners or directions.

Support plate 12 may include one or more reinforcing elements 76 (such as ribs 76, spines 76, or resilience spines 76) that are configured to reinforce and/or stiffen support plate 12. For example, in a heel portion 48 of support plate 12, one or more radially extending arms 68 may include a respective reinforcing element 76. In some examples, a respective reinforcing element 76 may project outwardly from a respective radially extending arm 68, such as outwardly from an upper surface of the arm (e.g., corresponding to upper surface 52 of support plate 12 and/or convex surface 64 of heel portion 48), away from outsole 26. Such reinforcing elements 76 may add thickness to areas of support plate 12 (e.g., heel portion 48), such as to radially extending arms 68, which may increase stiffness, rigidity, strength, and/or otherwise reinforce radially extending arms 68. In some examples, reinforcing elements 76 may add thickness to support plate 12 such that the thickness of support plate 12 in the areas of reinforcing elements 76 may be at least 25% thicker, at least 50% thicker, at least 75% thicker, at least 100% thicker, and/or at least 200% thicker than areas of support plate 12 without reinforcing elements 76. Such reinforcing elements 76 may be included on other portions of support plate 12, such as associated with lower surface 54, positioned on midfoot portion 16, medial leg 18, and/or lateral leg 20.

In some examples, a longitudinal axis of each respective reinforcing element 76 may be substantially parallel to a longitudinal axis of the respective radially extending arm 68, such that reinforcing elements 76 may extend along a respective radially extending arm 68, such as from central heel portion 70 and towards a respective peripheral end 72 of the radially extending arm 68.

Additionally or alternatively, support plate 12 may include one or more flexibility elements 78, such as one or more flexibility elements 78 formed in one or more radially extending arms 68 of heel portion 48. For example, flexibility elements 78 may be in the form of one or more slots 78 (e.g., cutouts, or areas where material has been removed, such that areas of support plate 12 are thinner than other areas of support plate 12 and/or areas where material is entirely absent) formed in one or more radially extending arms 68. In some examples, each of a plurality of radially extending arms 68 may include a respective flexibility element 78, such as a respective slot 78 formed therein and extending substantially parallel to the respective radially extending arm 68. In some examples, each respective flexibility element 78 may extend from central heel region 70 (e.g., from through-hole 74) towards a respective peripheral end 72 of a respective radially extending arm 68. In some examples, flexibility elements 78 may be continuous with through-hole 74 such that the through-hole 74 essentially extends along a portion of one or more of radially extending arms 68. Each respective flexibility element 78 may have a slot length that is less than a corresponding arm length of a respective radially extending arm 68, such that each respective slot 78 may extend along a portion of the length of the respective radially extending arm 68. In some examples, such an arrangement may form a continuous, undulating pattern surrounding central heel region 70, formed by flexibility elements 78 and/or radially extending arms 68.

Midfoot portion 16 may be formed integrally with both heel portion 48 and a forefoot portion 80 of support plate 12, such that midfoot portion 16 connects heel portion 48 and forefoot portion 80 (e.g., medial leg 18 and lateral leg 20). In other words, midfoot portion 16 may extend from and be continuous with heel portion 48, such as initiating at and extending from central heel region 70 and/or through-hole 74 of heel portion 48. Medial leg 18 and lateral leg 20 also may be formed integrally with heel portion 16 and may initiate at and extend from midfoot portion 16. Medial leg 18 and lateral leg 20 may extend longitudinally from midfoot portion 16 and extend towards anterior end 56 of support plate 12. In some examples, medial leg 18 and lateral leg 20 may be of similar or approximately equal lengths. In other examples, medial leg 18 may be longer than lateral leg 20, or lateral leg 20 may be longer than medial leg 18. For example, the longer one of medial leg 18 and lateral leg 20 may define anterior end 56 of support plate 12.

When positioned in sole assembly 14, medial leg 18 and lateral leg 20 (e.g., forefoot portion 80 of support plate 12) may be positioned to correspond with forefoot region 40 of sole assembly 14. For example, at least a portion of medial leg 18 may be positioned to underlie a portion of the wearer's foot adjacent the medial side of the foot when article of footwear 10 is worn. Similarly, at least a portion of lateral leg 20 may be positioned to underlie a portion of the wearer's foot adjacent the lateral side of the foot when article of footwear 10 is worn. In some examples, a portion of medial leg 18 (e.g., adjacent anterior end 56 of support plate 12) may be configured to underlie an area of the wearer's foot adjacent the foot's hallux (big toe), such as an area of the ball of the foot, adjacent the hallux, and/or may underlie a portion of the hallux itself. Similarly, a portion of lateral leg 20 may be configured to underlie at least one of the wearer's toes and/or may be configured to underlie a portion of the ball of the foot adjacent one or more of the wearer's toes.

One or more portions of medial leg 18 and/or lateral leg 20 may cross a longitudinal centerline 84 (which also may be referred to herein as a longitudinal midline 84) of support plate 12, such that, for example, said portions of medial leg 18 may underlie the lateral side of the wearer's foot, and/or said portions of lateral leg 20 may underlie the medial side of the wearer's foot. It also is within the scope of the present disclosure that at least one of the medial leg and the lateral leg may include a plurality of regions that extend across longitudinal centerline 84, with these regions being separated by portions of the leg(s) that do not extend across the longitudinal centerline. The longitudinal centerline 84 of support plate 12 may be a line intersecting the center of the largest width (lateral-to-medial distance) of the heel portion 48 of the support plate and the center of the largest width of the support plate between the medial leg and the lateral leg.

In some examples, medial leg 18 and lateral leg 20 may branch out from midfoot portion 16 of support plate 12 and diverge from each other, such that an open plate space 82 is formed between medial leg 18 and lateral leg 20. Medial leg 18 and lateral leg 20 may continue to diverge as they extend away from heel portion 48, may change angle/orientation with respect to one another, may be substantially parallel to one another, and/or may converge towards each other in various areas of examples of support plates 12 according to the present disclosure. In some examples, medial leg 18 and lateral leg 20 may extend independently from each other from heel portion 48 towards anterior end 56 of support plate 12. In other examples, portions of medial leg 18 and lateral leg 20 may be coupled to one another at one or more locations. Support plates 12 according to the present disclosure may include at least one additional leg without departing from the scope of the present disclosure. It also is within the scope of the present disclosure that a support plate 12 may include only a medial leg 18, only a lateral leg 20, or a single forefoot leg that extends under the medial and lateral forefoot portions of the wearer's foot.

Open plate space 82 may extend from midfoot portion 16 of support plate 12 to anterior end 56 of support plate 12. In some examples, at least a portion of open plate space 82 may be substantially triangular, substantially polygonal, and/or irregularly shaped. In some examples, at least a portion of open plate space 82 may be positioned between longitudinal centerline 84 and medial edge 59 of support plate 12. Additionally or alternatively, at least a portion of open plate space 82 may be positioned between longitudinal centerline 84 and lateral edge 61 of support plate 12. At least a portion of open plate space 82 may be curved and/or may wind around medial leg 18 and/or lateral leg 20.

In some examples, open plate space 82 may be sized and/or shaped so as to prevent (or at least reduce the likelihood of) rocks or other objects from causing pain to a wearer's foot when such rocks or other objects are stepped on by the wearer while wearing footwear 10. For example, portions of medial leg 18 and/or lateral leg 20 may be formed to weave in and/or out of portions of open plate space 82 such as to provide protection to a wearer's foot. In some examples, medial leg 18 and/or lateral leg 20 may be configured to provide rock protection to a wearer's foot, such as providing expanses, or barriers, between the wearer's foot and the outer surface of outsole 26.

Medial leg 18 and lateral leg 20 may take any suitable shape, as desired for the particular application of support plate 12 and/or article of footwear 10. Medial leg 18 and lateral leg 20 may diverge from each other adjacent midfoot portion 16, and later change direction to extend back towards one another. For example, medial leg 18 may extend towards medial edge 59 of support plate 12, and then change directions to extend towards lateral edge 61 of support plate 12. In some examples, such as discussed in more detail with respect to FIG. 3, one or more first portions 138 of medial leg 18 may be positioned between longitudinal centerline 84 and medial edge 59, while one or more second portions 140 of medial leg 18 may be positioned between longitudinal centerline 84 and lateral edge 61 (e.g., a portion of medial leg 18 may cross longitudinal centerline 84). Similarly, one or more portions 142 of lateral leg 20 may cross longitudinal centerline 84, being positioned between longitudinal centerline 84 and medial edge 59 of support plate 12. Medial leg 18 and lateral leg 20 may be shaped to be corresponding to each other, such that a portion of medial leg 18 and/or lateral leg 20 may be shaped to receive a portion of the other respective leg. For example, lateral leg 20 may be shaped to receive second portion 140 of medial leg 18 that extends across longitudinal centerline 84 of support plate 12.

Medial leg 18 and/or lateral leg 20 optionally may include one or more centrally extending teeth 86 extending towards longitudinal centerline 84 of support plate 12 and/or into open plate space 82. Additionally or alternatively, medial leg 18 and/or lateral leg 20 may include one or more ribs 88, which may be an example of reinforcing elements 76. Each rib 88 may correspond to an area of increased stiffness and/or increased thickness of support plate 12. One or more ribs 88 may be formed on upper surface 52 and/or lower surface 54 of medial leg 18 and/or lateral leg 20. For example, one or more ribs 88 may take the form of an area of increased thickness projecting from upper surface 52 of support plate 12. Additionally or alternatively, medial leg 18 and/or lateral leg 20 may include one or more grooves 90 corresponding to areas of increased flexibility and/or movement of support plate 12. Grooves 90 may be an example of flexibility element 78. Grooves 90 may be formed on or in upper surface 52 and/or lower surface 54 of medial leg 18 and/or lateral leg 20. For example, one or more grooves 90 may correspond to an area of decreased thickness of medial leg 18 and/or lateral leg 20.

Additionally or alternatively, support plate 12 may include one or more projections 92 formed thereon, each projection 92 being configured for alignment and placement of support plate 12 with respect to sole assembly 14 and/or article of footwear 10. For example, medial leg 18 and/or lateral leg 20 may include one or more projections 92 projecting outwardly from lower surface 54, which may engage with outsole 26, such as extending at least partially into or through apertures or other portions of outsole 26 that are designed to receive a respective projection 92. Projection 92 additionally or alternatively may be referred to as an alignment guide 92, an outsole-extending mount 92, and/or a projecting tab 92.

Different areas of support plate 12 may be configured to have different properties than other respective areas of support plate 12. For example, some areas of support plate 12 may have a greater stiffness, lesser stiffness, lesser compliance, or greater compliance than other areas of support plate 12. For example, medial leg 18 and/or lateral leg 20 may have a greater stiffness than heel portion 48 (e.g., radially extending arms 68 of heel portion 48) of support plate 12. In other examples, medial leg 18 and/or lateral leg 20 may have a lesser stiffness than heel portion 48, or the stiffness of heel portion 48 may be approximately equal to the stiffness of medial leg 18 and/or lateral leg 20. Medial leg 18, lateral leg 20, and/or radially extending arms 68 may have flexibility, stiffness, and/or spring characteristics that are different from each other. In some examples, medial leg 18 and/or lateral leg 20 may have a stiffness or spring constant greater than the stiffness or spring constant of heel portion 48 (e.g., domed structure 62). For example, medial leg 18 and/or lateral leg 20 may have a stiffness or spring constant that is at least two times larger, at least three times larger, at least five times larger, at least ten times larger, at least 20 times larger, at least 50 times larger, and/or at least 100 times larger than the stiffness or spring constant of heel portion 48 (e.g., domed structure 62 and/or radially extending arms 68). In these examples, support plate 12 may be configured to provide increased stiffness, rigidity, protection, and/or support in the forefoot region 40 of article of footwear 10.

In other examples, medial leg 18 and/or lateral leg 20 may have a stiffness or spring constant that is less than the stiffness or spring constant of heel portion 48 (e.g., domed structure 62). For example, medial leg 18 and/or lateral leg 20 may have a stiffness or spring constant that is at least two times lesser, at least three times lesser, at least five times lesser, at least ten times lesser, at least 20 times lesser, at least 50 times lesser, and/or at least 100 times lesser than the stiffness or spring constant of heel portion 48 (e.g., domed structure 62 and/or radially extending arms 68). In these examples, support plate 12 may be configured to provide increased flexibility, pliability, elasticity, cushioning, and/or support the forefoot region 40 of article of footwear 10.

Additionally or alternatively, medial leg 18 and lateral leg 20 may have a different stiffness or spring constant from each other, which may be configured to provide greater or lesser stiffness on the medial or lateral sides of support plate 12, accordingly, which may contribute to control inversion and/or eversion of a foot during a walking gait. In other examples, medial leg 18, lateral leg 20, and heel portion 48 (e.g., radially extending arms 68 and domed structure 62) may all have a substantially uniform stiffness or spring constant.

FIG. 1 further illustrates that support plate 12 may include one or more cross-braces 94 that may be configured to add torsional stability or otherwise strengthen support plate 12. In some examples, one or more cross-braces 94 may extend from medial leg 18 to lateral leg 20, across longitudinal centerline 84 of support plate 12. Thus, one or more cross-braces 94 may couple medial leg 18 to lateral leg 20 in one or more locations. In some examples, one or more cross-braces may extend substantially transversely across a width 98 of support plate 12 (e.g., substantially perpendicular to longitudinal centerline 84). Cross-braces 94 may be formed of the same material as medial leg 18 and/or lateral leg 20. In some examples, cross-braces 94 may include one or more other materials different from medial leg 18 and/or lateral leg 20.

Midfoot portion 16 of support plate 12 may be configured to provide arch support to a wearer of article of footwear 10. For example, midfoot portion 16 may include a support arch 96 configured to underlie and support the arch of the wearer's foot. Support arch 96 may at least partially conform to the arch of the wearer's foot. As used herein, support plate 12 may be said to "conform" to a wearer's foot or portion thereof if it generally takes the shape of one or more portions of the wearer's foot. For example, support plate 12 may be curved and have a three-dimensional shape in order to generally follow the natural shape or contour of an average human foot. For example, arch support 96 may be generally arch-shaped, with the bases of the arch being formed by heel portion 48 and midfoot portion 16 and/or forefoot portion 80, with support arch 96 being raised with respect to the areas of support plate 12 on either side of support arch 96. As used herein, "conform" does not generally mean that support plate 12 is customized for a particular individual's foot, but such individualized customization is not precluded.

Midfoot portion 16 and/or support arch 96 of midfoot portion 16 may be configured to deform from a resting form (e.g., the shape of support plate 12 without external forces acting on it) such that it deflects under the weight of the wearer such that lower surface 54 corresponding to midfoot portion 16 and/or support arch 96 is forced downward towards outsole 26 of article of footwear 10 when weight is placed on support plate 12 (e.g., when the wearer is standing on that foot, and/or during portions of the wearer's stride where weight is placed on that foot). Support arch 96 (and/or midfoot portion 16, generally) may be configured to return to its resting form when the weight is removed from sole assembly 14 (e.g., when the wearer lifts the foot on which the respective article of footwear 10 is being worn). In some examples, when the weight is removed from sole assembly 14 and support arch 96, support plate 12 may be configured to generate, or produce, a return force towards upper surface 52 of midfoot portion 16.

Additionally or alternatively, other portions of support plate 12 may be configured to resiliently deform in response to a force placed on sole assembly 14 during use by a wearer, and then resiliently recover in response to the force being removed from sole assembly 14. For example, heel portion 48 (e.g., domed structure 62) may be compressed such that convex surface 64 is pressed towards outsole 26, and then return to a resting form when the weight is removed. Medial leg 18 and/or lateral leg 20 may be configured to provide energy return to a wearer of article of footwear 10. For example, one or more portions of support plate 12 may be configured to store energy during a portion of the wearer's stride and release the stored energy at a different portion of the wearer's stride. In other words, in a walking gait, as pressure is applied to the heel region 44, midfoot region 42, and forefoot region 40 of article of footwear 10, corresponding aspects of support plate 12 (e.g., heel portion 48, midfoot portion 16, and forefoot portion 80, respectively) may be bent or deformed, absorbing the mechanical energy of the stride, and then return some of the mechanical energy by restoring their shape. For example, support plates 12 may be configured to return at least 1%, at least 5%, at least 10%, at least 25%, at least 50%, at least 75%, at least 90%, and/or at least 95% of the force exerted onto support plate 12 by the wearer.

Support plate 12 may be formed of any suitable material, which may include one or more of carbon fiber, a composite material, a nylon (e.g., nylon-6), thermoplastic materials (e.g., thermoplastic polyurethane (TPU)), polyvinyl acetates, polyethylene vinyl acetate (PEVA), rubbers, resins, polyesters, polyethers, metals, alloys, metalloids, and/or combinations thereof. Other materials also are possible and within the scope of the present disclosure. In some examples, support plate 12 may be formed by injection molding and/or thermoforming. In some examples, support plate 12 may be formed from a dual density material, such that different areas of support plate 12 have different densities or levels of compliance than other areas of support plate 12. For example, midfoot portion 16 of support plate 12 may be formed of a material having a greater density than the material of heel portion 48 in some examples. Additionally or alternatively, medial leg 18 and/or lateral leg 20 may be formed of a material having a greater density than the material forming heel portion 48.

Width 98 (FIG. 1) of support plate 12 may be defined as the distance between medial edge 59 and lateral edge 61, and may vary along a length 99 of support plate 12, the length 99 being defined as the distance between anterior end 56 and posterior end 58 of support plate 12. For example, width 98 of support plate in midfoot portion 16 may be less than the respective widths 98 in heel portion 48 and/or forefoot portion 80. A thickness 100 (FIG. 2) of support plate 12 may be defined as the distance between upper surface 52 and lower surface 54, and may also vary along the length 99 and/or width 98 of support plate 12. For example, thickness 100 in heel portion 48 may be greater than a respective thickness 100 in midfoot portion 16 and/or forefoot portion 80 of support plate 12. Additionally or alternatively, midfoot portion 16 (e.g., support arch 96) may have an increased thickness 100 as compared to at least one other area of support plate 12.

The size, shape, and configuration of support plate 12 and sole assembly 14 may vary between examples, depending in part on the footwear type in which support plate 12 and corresponding sole assembly 14 are used. In some examples and at various points along the length of support plate 12, the width 98 of support plate 12 may be at least 5% of, at least 10% of, at least 25% of, at least 50% of, at least 75% of, at least 90% of, and/or greater than 95% of a width 101 of sole assembly 14 and/or article of footwear 10. Similarly, the length 99 of support plate 12 may be at least 5% of, at least 10% of, at least 25% of, at least 50% of, at least 75% of, at least 90% of, and/or greater than 95% of length 51 of sole assembly 14 and/or article of footwear 10.

Turning now to FIGS. 3-13, examples of components of articles of footwear 10 in the form of support plates 12 and sole assemblies 14 are illustrated. Where appropriate, the reference numerals from the schematic illustrations of FIGS. 1-2 are used to designate corresponding parts of support plates 12 and sole assemblies 14; however, the examples of FIGS. 3-13 are non-exclusive and do not limit support plates 12 and sole assemblies 14 to the illustrated embodiments. That is, support plate 12 and sole assembly 14 are not limited to the specific embodiments illustrated in FIGS. 3-13, and may incorporate any number of the various aspects, configurations, characteristics, properties, etc. that are illustrated in and discussed with reference to the schematic representations of FIGS. 1-2 and/or the embodiments of FIGS. 3-13, as well as variations thereof, without requiring the inclusion of all such aspects, configurations, characteristics, properties, etc. In addition, footwear 10 and/or sole assembly 14 of FIGS. 1-2 may include the support plate 12, the sole assembly 14, and/or components thereof, of any of FIGS. 3-13 without departing from the scope of the present disclosure. This is indicated schematically in FIGS. 3-13 by the inclusion of reference numerals 10 and 14. For the purpose of brevity, each previously discussed component, part, portion, aspect, region, etc. or variants thereof may not be discussed, illustrated, and/or labeled again; however, it is within the scope of the present disclosure that the previously discussed features, variants, etc. may be utilized with presently disclosed support plates, sole assemblies, and articles of footwear.

Figure 3:
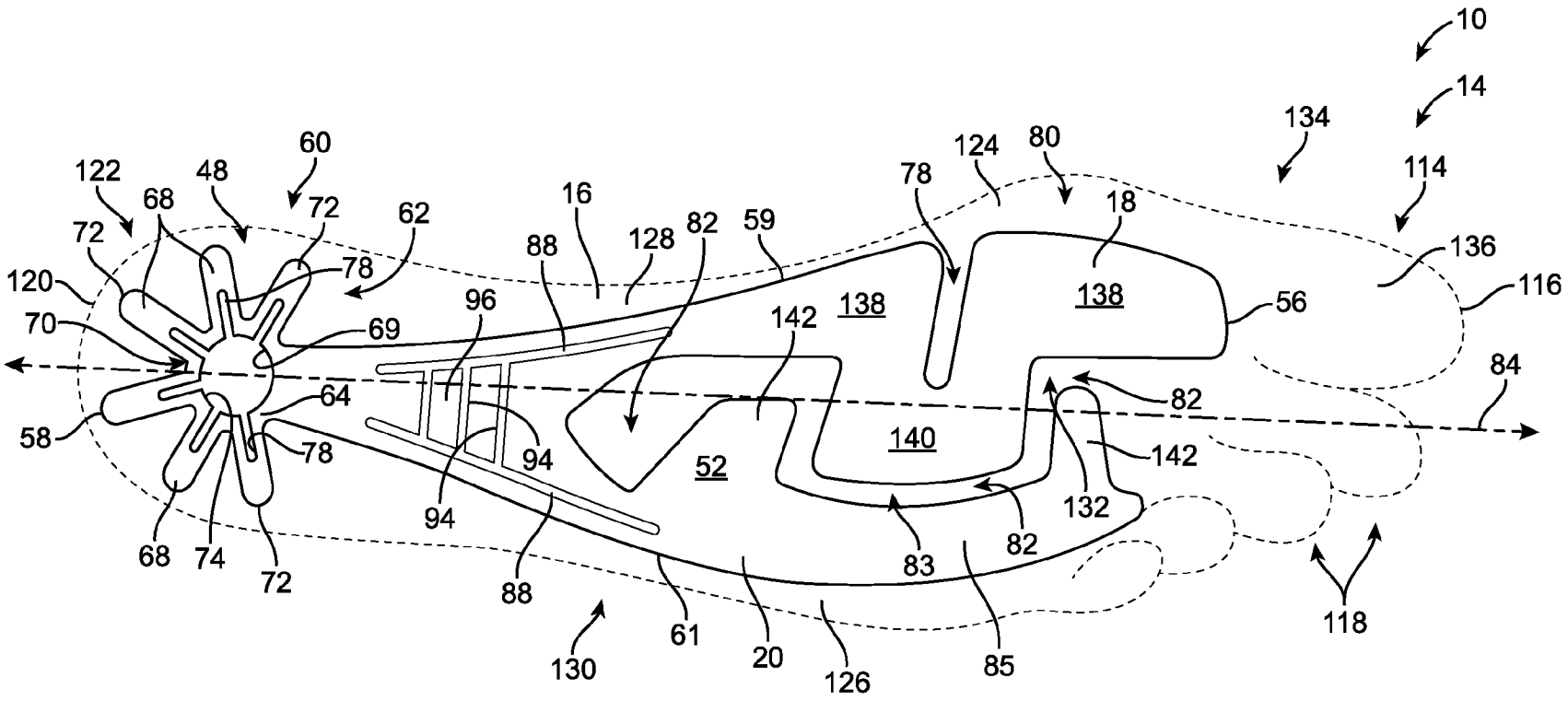
FIG. 3 is a top plan view of an example of a support plate for use in an article of footwear according to the present disclosure, superimposed on a schematic outline of a wearer's foot.
Figure 4:
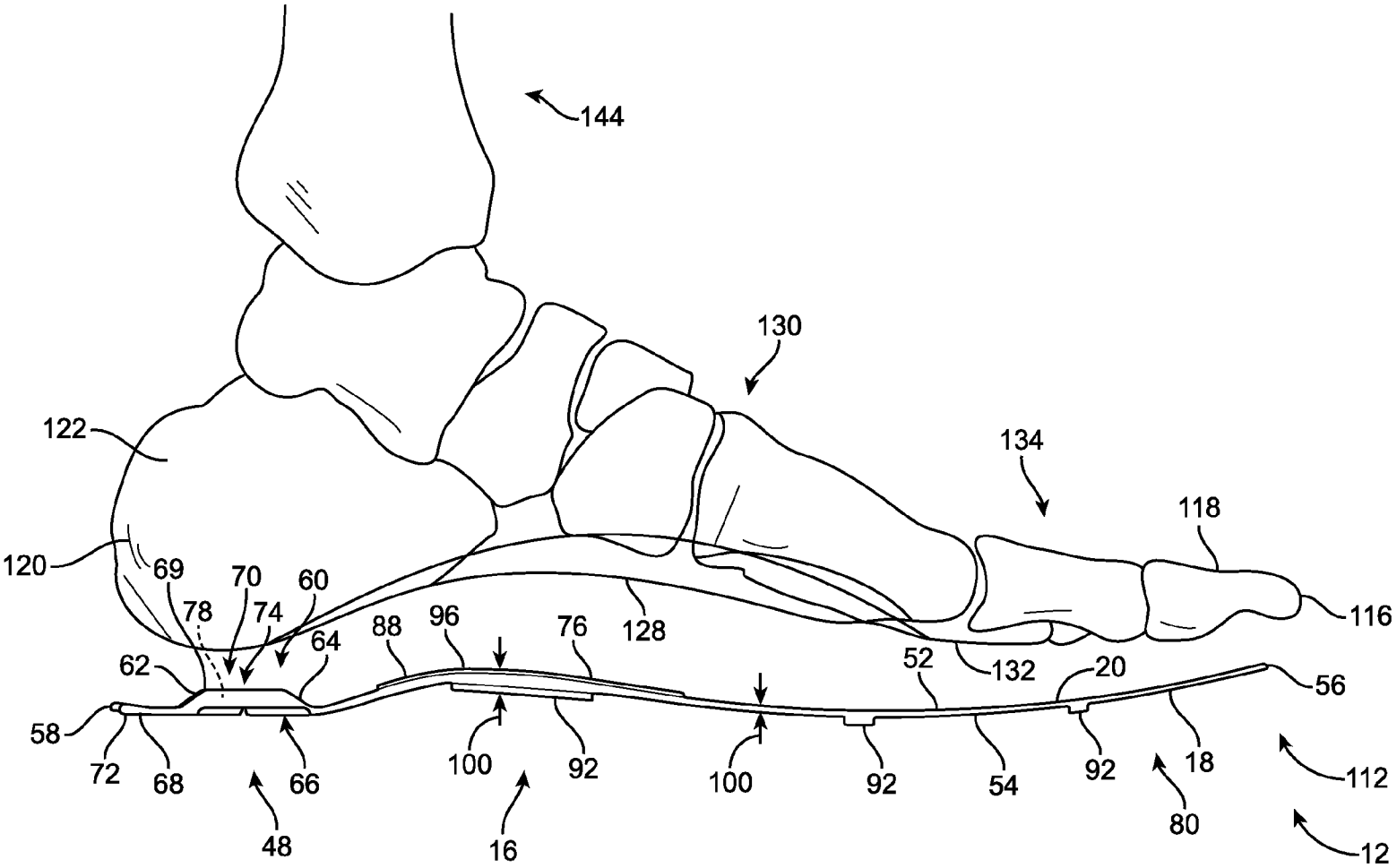
FIG. 4 is a side elevation view of the support plate of FIG. 3, shown with a schematic representation of placement of a wearer's foot relative to the support plate.
Figure 5:
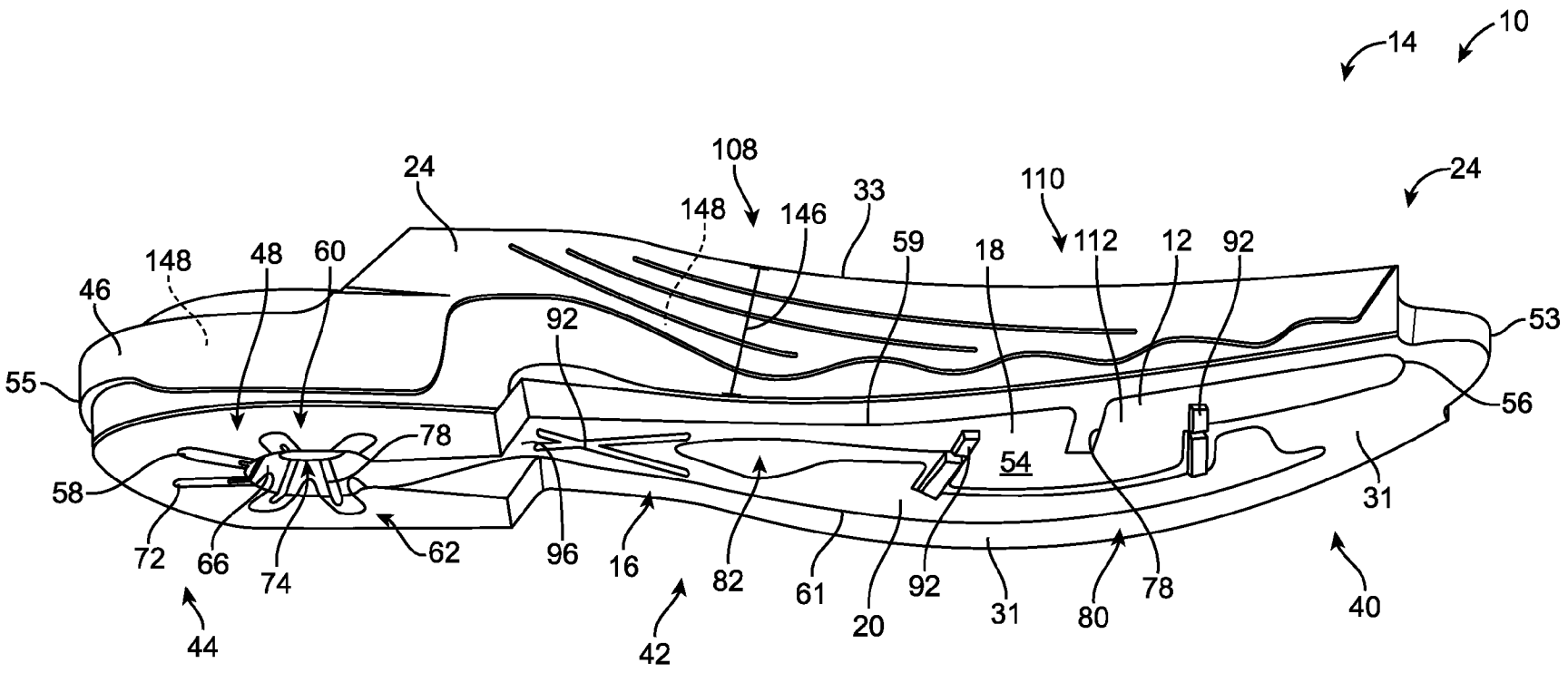
FIG. 5 is a perspective view of an example of a midsole having the support plate of FIGS. 3-4 embedded therein, viewed from the bottom of the midsole, according to the present disclosure.

FIGS. 3-5 illustrate an example of support plate 12, in the form of support plate 112, shown from above in FIG. 3, from the side in FIG. 4, and from the bottom and embedded within a midsole 24 in FIG. 5. Additionally, FIG. 3 illustrates a schematic representation of a wearer's foot 114, to illustrate one example of proportion and alignment of support plate 112 with respect to foot 114. Foot 114 generally extends longitudinally from an anterior foot end 116 adjacent the toes 118, to a posterior foot end 120 adjacent the heel 122. Laterally, foot 114 may extend from a medial side 124 to a lateral side 126. An arch 128 of foot 114 may be formed in the midfoot region 130 of foot 114, with the ball 132 of foot 114 generally in the forefoot region 134 of foot 114. Hallux 136 is generally positioned on the medial side 124 of foot 114.

As shown in FIG. 3, generally, heel portion 48 of support plate 112 may underlie the wearer's heel 122, midfoot portion 16 of support plate 112 may underlie midfoot region 130 of foot 114, and medial leg 18 and lateral leg 20 of support plate 112 may underlie forefoot region 134 of foot 114. Medial leg 18 may generally extend from arch support 96 to anterior end 56 of support plate 112, with a portion of medial leg 18 adjacent anterior end 56 being positioned under a portion of adjacent hallux 136. Medial leg 18 may diverge from lateral leg 20 at midfoot portion 16, and extend towards medial edge 59 of support plate 112. In some examples, medial leg 18 may change directions and extend back towards lateral edge 61 of support plate, towards lateral leg 20, and/or may cross longitudinal centerline 84 of support plate 112. Thus, medial edge 18 may include a first portion 138 adjacent medial edge 59 of support plate 112, and a second portion 140 that extends across centerline 84, towards lateral edge 61. Similarly, lateral leg 20 may extend from midfoot portion 16, divergent from medial leg 18, such that open plate space 82 may be formed therebetween. Lateral leg 20 may include one or more changes of directions, such that one or more third portions 142 may extend towards medial leg 18 and/or may cross longitudinal centerline 84 in some examples. Medial leg 18 and lateral leg 20 may take a variety of shapes and sizes, with straight edges and curved edges that may be generally contoured to shapes of wearer's feet, and/or configured to produce desired support and energy return characteristics. In some examples, medial leg 18 and lateral leg 20 (and open plate space 82 therebetween) may be configured to provide rock protection to the wearer. For example, medial leg 18 and lateral leg 20 may together underlie a significant portion of the wearer's midfoot and/or forefoot, thereby prevent rocks or other sharp objects from poking or otherwise causing discomfort to the wearer's foot through sole assembly 14 in the areas of medial leg 18 and lateral leg 20.

As shown in FIG. 3, at least a portion of open plate space 82 may be irregularly shaped. Open plate space 82 may generally extend from midfoot portion 16 to anterior end 56 of support plate 112. At least a portion of open plate space 82 may be curved (e.g., a curved portion 83) and/or may wind around medial leg 18 and/or lateral leg 20, as shown. Such curved portion 83 and/or winding of open plate space 82 may correspond to portions of medial leg 18 and lateral leg 20 that are shaped to be complimentary to each other. For example, a portion 85 of lateral leg 20 (which may be adjacent curved portion 83 of open plate space 82) may be sized and shaped to receive second portion 140 of medial leg 18, as it extends across longitudinal centerline 84, into the lateral side of the article of footwear.

Portions of open plate space 82 may be positioned on either side of longitudinal center line 84, such as between longitudinal center line 84 and medial edge 59, and/or between longitudinal center line 84 and lateral edge 61. In some examples, open space plate 82 may define a gap between medial led 18 and lateral leg 20 that sequentially extends across opposed sides of longitudinal centerline 84 of support plate 112.

FIG. 4 illustrates support plate 112 generally aligned under a schematic representation of the bone structure 144 of a wearer's foot. As best seen in FIG. 4, domed structure 62 of heel portion 48 of support plate 112 may generally form a raised dome that extends up from lower surface 54 of support plate 112, and may generally be positioned under the wearer's heel 122. Domed structure 62 may be configured to elastically deform or compress under the impact force of a heel strike (e.g., heel 122 impacting the ground on which the wearer is walking). Midfoot portion 16 of support plate 112 may extend from heel portion 48, and may generally curve upward (e.g., towards the wearer's foot) to form arch support 96 that may generally be positioned under or adjacent the wearer's arch 128. Arch support 96 may also be compressed, such as when the arch 128 of the wearer's foot pressure downward onto support plate 112 during the gait. As the forces in arch support 96 are carried toward the ground, arch support 96 may push outward (e.g., thrust), which thrust may be restrained by carrying away the downward force along curved lines of the medial edge 59 and lateral edge 61 of support plate 112. When the weight is removed from midfoot region 16 of support plate 112, arch support 96 may return to its resting form (as shown in FIG. 4), and/or may return a portion of that energy to the wearer.

Arch support 96 may include one or more reinforcing elements 76, such as one or more ribs 88 projecting away from upper surface 52 of support plate 112, in the vicinity of arch support 96. As shown in FIG. 4, reinforcing elements 76 may represent areas of increased thickness of support plate 112, as compared to adjacent areas of the plate without reinforcing elements 76. Additionally or alternatively, midfoot portion 16 (which includes arch support 96) may include one or more projections 92 extending outwardly from lower surface 54 of support plate 112 in the vicinity of arch support 96. Projections 92 may represent areas of increased thickness of support plate 112, as compared to adjacent areas of support plate 112 without projections 92. Projections 92 may be configured to facilitate alignment with other components of a sole assembly, such as with an outsole that may engage lower surface 54 of support plate 112. In some examples, projections 92 may extend at least partially through the thickness of the outsole, and/or may be visible from the outer surface of the outsole. One or more projections 92 also may be present in other areas of support plate 112, as shown in FIG. 4. For example, projections 92 may be formed in the forefoot region 80 of support plate 112, extending outward from lower surface 54 in the areas of medial leg 18 and/or lateral leg 20.

In addition to curvature at arch support 96, support plate 112 also may be curved in forefoot portion 80, as shown in FIG. 4. For example, support plate 112 may generally curve downward (e.g., towards a ground surface underneath article of footwear 10) from arch support 96 in an area underlying ball 132 of the foot. Support plate 112 may again curve upwards (e.g., away from the ground surface) as it approaches anterior end 56 of support plate 112, underlying at least a portion of toes 118. Support plate 112 may thusly be generally shaped and sized to conform to the natural anatomy of a wearer's foot.

FIG. 5 shows support plate 112 at least partially embedded in midsole 24, adjacent bottom midsole surface 31. In some examples, lower surface 54 of support plate 112 may be substantially flush with bottom midsole surface 31, with projections 92 and/or reinforcing elements 76 extending away from lower surface 54 in some examples (e.g., any projections 92 and/or reinforcing elements 76 formed extending outward from lower surface 54 of support plate 112 may extend beyond the plane of bottom midsole surface 31, even if the rest of lower surface 54 is substantially flush with bottom midsole surface 31). As shown in FIG. 5, domed structure 62 may extend upwards into midsole heel region 46, with a portion of midsole heel region 46 being positioned above heel portion 48 of support plate 112, such that impact forces from a wearer's heel may be transmitted through a portion of midsole heel region 46, to heel portion 48 of support plate 112.

Figure 6:
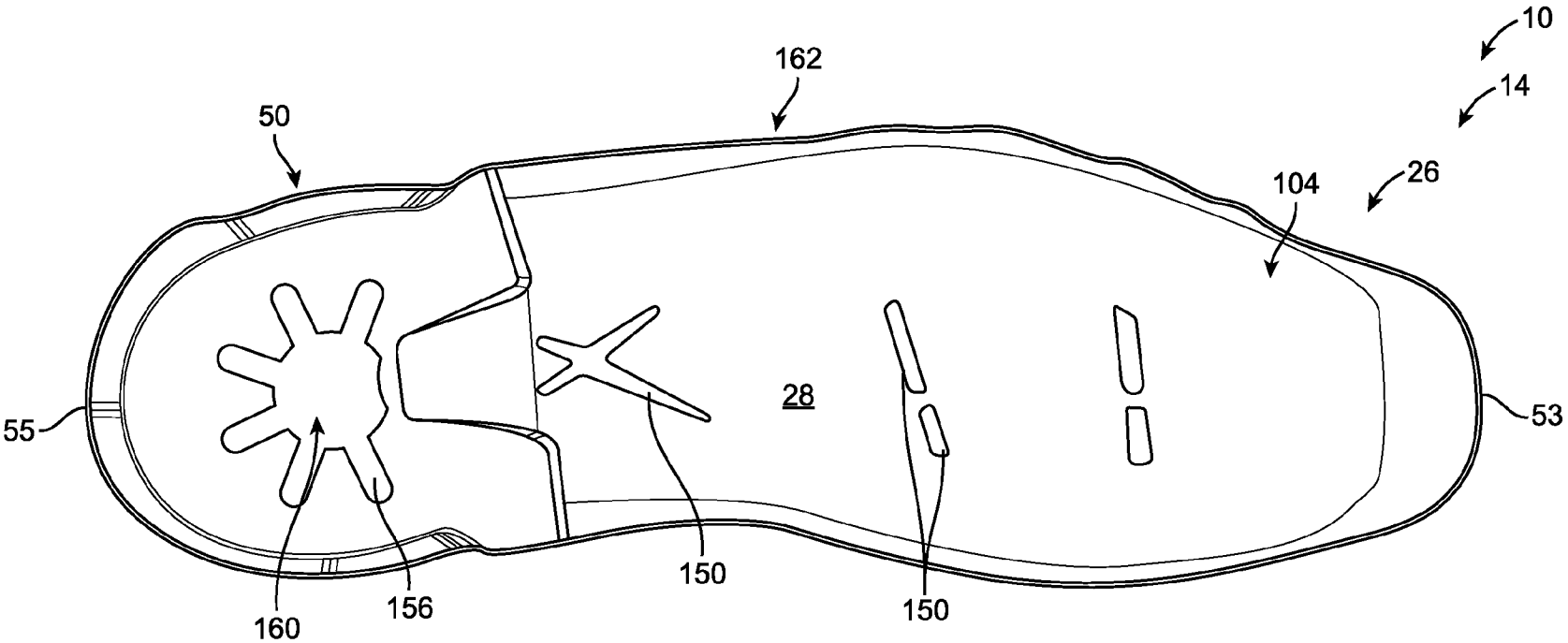
FIG. 6 is a top plan view of an example of an outsole for use in a sole assembly of an article of footwear according to the present disclosure.
Figure 7:
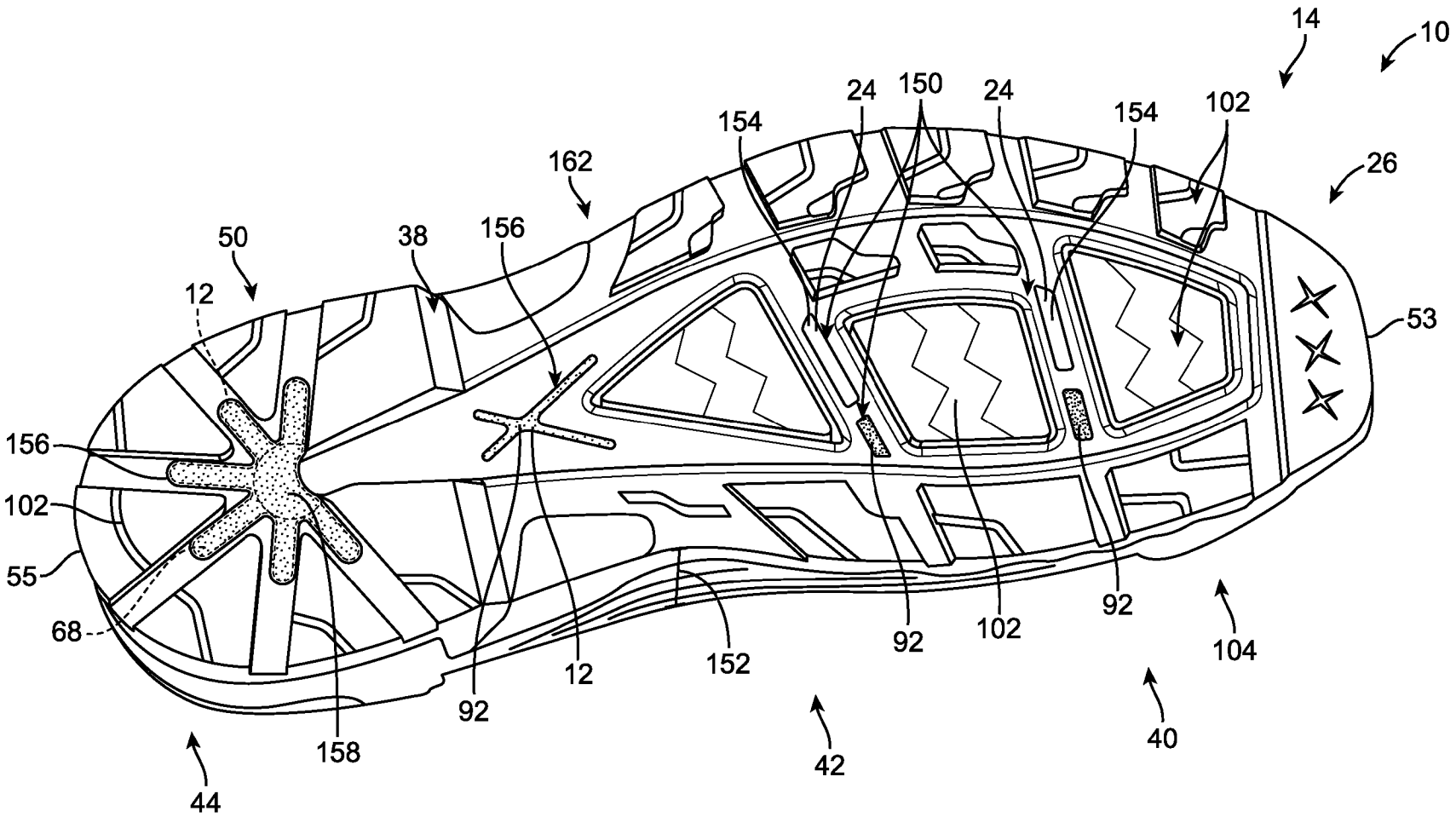
FIG. 7 is a schematic representation of an example of an outsole for use in a sole assembly of an article of footwear according to the present disclosure, showing a bottom perspective view of the outsole, with portions of a support plate visible therethrough.

Support plate 112 may have a thickness 100 that extends at least 5% into, at least 10% into, at least 25% into, at least 50% into, at least 75% into, at least 90% into, at least 95% into, and/or all the way through a midsole thickness 146 of midsole 24 and/or similarly through and/or into outsole 26 (FIGS. 6-7). The degree to which support plate 112 extends into sole assembly 14 may result in some or all of support plate 112 being embedded within outsole 26 and/or midsole 24.

In some examples, midsole 24 may include one or more compliant areas 148, which may be more compliant than other areas of midsole 24. For example, compliant areas 148 may be formed of a compliant material, such as gel and/or foam, and/or may have a lower density than adjacent areas of midsole 24. For example, midsole heel region 46 may include one or more compliant areas 148, which may provide extra cushioning for the wearer during heel impacts, and/or facilitate transmission of the impact force to heel portion 48 of support plate 112.

FIGS. 6 and 7 illustrate examples of outsole 26, which may be part of disclosed sole assemblies 14 and articles of footwear 10 according to the present disclosure. FIG. 6 illustrates outsole 26 alone, viewed from the top, looking down on inner surface 28 of outsole 26, while FIG. 7 illustrates outsole 26 from the bottom (e.g., showing outer surface 30 of outsole 26), with a support plate 12 and midsole 24 engaged with outsole 26. Outsole 26 may include one or more cut-outs 150 extending at least partially through an outsole thickness 152 (e.g., from inner surface 28 to or towards outer surface 30 of outsole 26), into and/or through which portions of other structures of sole assembly 14 may extend and/or be visible. For example, as shown in FIG. 7, portions of support plate 12, such as projections 92, may extend into and/or through one or more cut-outs 150 of outsole 26 such that a portion of support plate 12 may be visible from outer surface 30 of outsole 26, and/or portions of support plate 12 may extend through at least a portion of outsole thickness 152. Also as shown in FIG. 7, portions of midsole 24, such as portions 154, may extend through at least a portion of one or more cut-outs 150 in outsole 26. Such portions 154 and projections 92 may, for example, facilitate alignment of outsole 26 with other components of sole assembly 14.

In some examples, outsole 26 may include one or more (optional) transparent portions 156, such as transparent portion 156 shown incorporated into outsole heel region 50. Transparent portion 156 may be at least partially transparent or translucent, such as may allow at least partial visibility of other structures of sole assembly 14 through transparent portion 156. For example, as shown in FIG. 7, a part of heel portion 48 of support plate 12 may be at least partially visible through transparent portion 156 in some examples. In some examples, outer surface 30 of outsole 26 may include a concave portion 158 in outsole heel region 50, such as may conform to a domed structure (e.g., domed structure 62) of a heel portion of support plate 12. For example, concave portion 158 (and corresponding convex portion 160 formed on inner surface 28 of outsole 26) of outsole heel region 50 may be sized and shaped to be seated inside a heel portion of support plate 12, such as by positioning convex portion 160 of outsole heel region 50 adjacent and/or inside concave surface 66 of domed structure 62 of support plate 12, such as may be seen in FIG. 5. Outsole heel region 50 may be an integral portion of outsole 26 in some examples, or may be an external outsole heel region 50 that is coupled to outsole 26. Additionally or alternatively, outsole heel region 50 may be a projecting heel (e.g., projecting heel 38), as shown in FIG. 7.

FIG. 7 illustrates various tread regions 102 on outsole forefoot 104, such as on ground-contacting surface 106 (e.g., outer surface 30 of outsole 26) adjacent outsole heel region 50, outsole forefoot region 104, and/or an outsole midfoot region 162. Such tread regions 102 and associates patterns and features are shown for illustrative purposes only, and are not meant to be limiting in any way. Various examples of outsoles 26 and articles of footwear 10 may include any suitable patterns of tread regions 102 and/or other features on outer surface 30 and/or ground-contacting surface 106, within the scope of the present disclosure.

Figure 8:
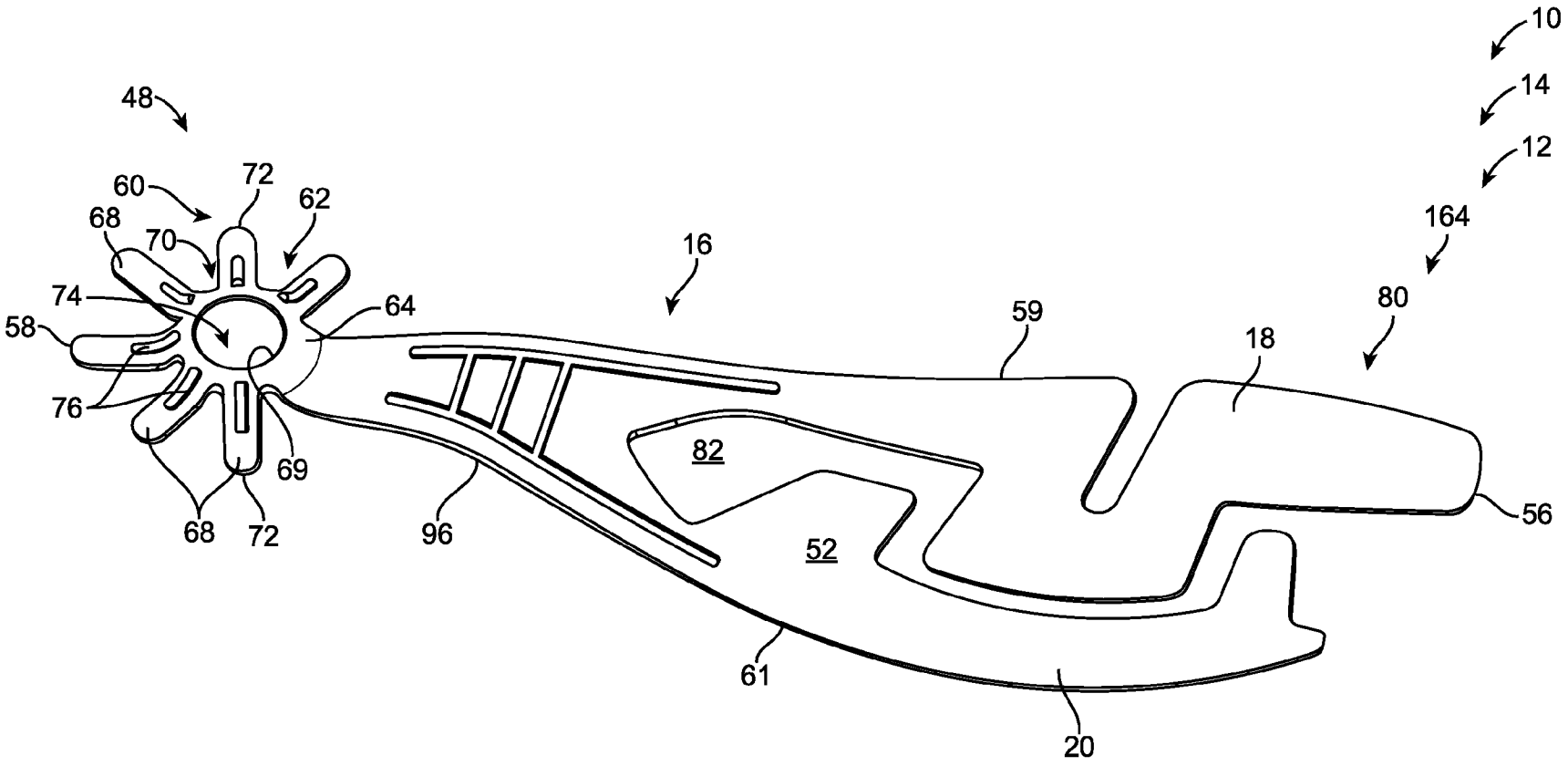
FIG. 8 is a top perspective view of another example of a support plate for use in an article of footwear according to the present disclosure.
Figure 9:
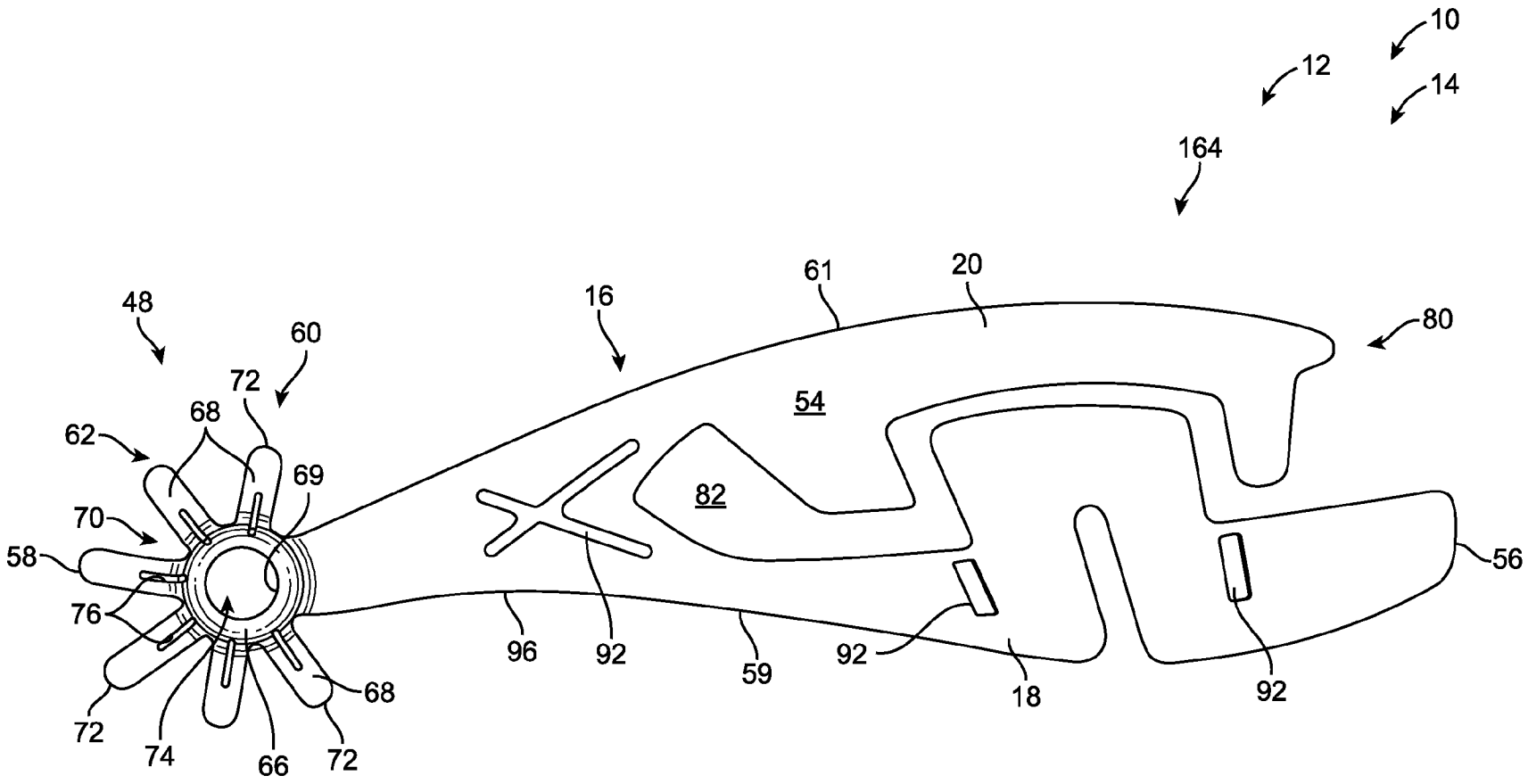
FIG. 9 is a bottom perspective view of the support plate of FIG. 8.

FIGS. 8-13 illustrate other various examples of support plates 12 that may be incorporated within sole assemblies 14 and articles of footwear 10 according to the present disclosure. For example, FIGS. 8-9 illustrate another embodiment according to the present disclosure, support plate 164 (which is an example of support plate 12), shown from the top (FIG. 8) and bottom (FIG. 9) of support plate 164. Support plate 164 may generally be similar to support plate 162 of FIGS. 3-5, except that radially extending arms 68 of heel portion 48 may each include a respective reinforcing element 76, as opposed to flexibility elements 78 shown in support plate 112 of FIGS. 3-5. For example, one or more radially extending arms 68 of domed structure 62 may include a respective reinforcing element 76 projecting outwardly from upper surface 52 and/or lower surface 54 of the arms.

FIGS. 8-9 illustrate reinforcing elements 76 on both surfaces of radially extending arms, but reinforcing elements 76 may be present on just one surface (e.g., either upper surface 52 or lower surface 54) in some embodiments. Furthermore, FIGS. 8-9 show every radially extending arm 68 including a respective reinforcing element 76, but in some embodiments, only a portion of radially extending arms may include such a reinforcing element. In some examples, a respective radially extending arm 68 may include two or more reinforcing elements 76. In some examples, reinforcing elements 76 may be oriented differently with respect to radially extending arms 68, and/or may be shaped differently than shown. In some examples, one or more radially extending arms 68 may include a respective reinforcing element 76 as shown in FIGS. 8-9, while one or more radially extending arms 68 may include a respective flexibility element 78. Heel portion 48 of FIGS. 8-9 may generally be stiffer than heel portion 48 as shown in FIGS. 3-5, due at least partially to reinforcing elements 76 of support plate 164.

Figure 10:
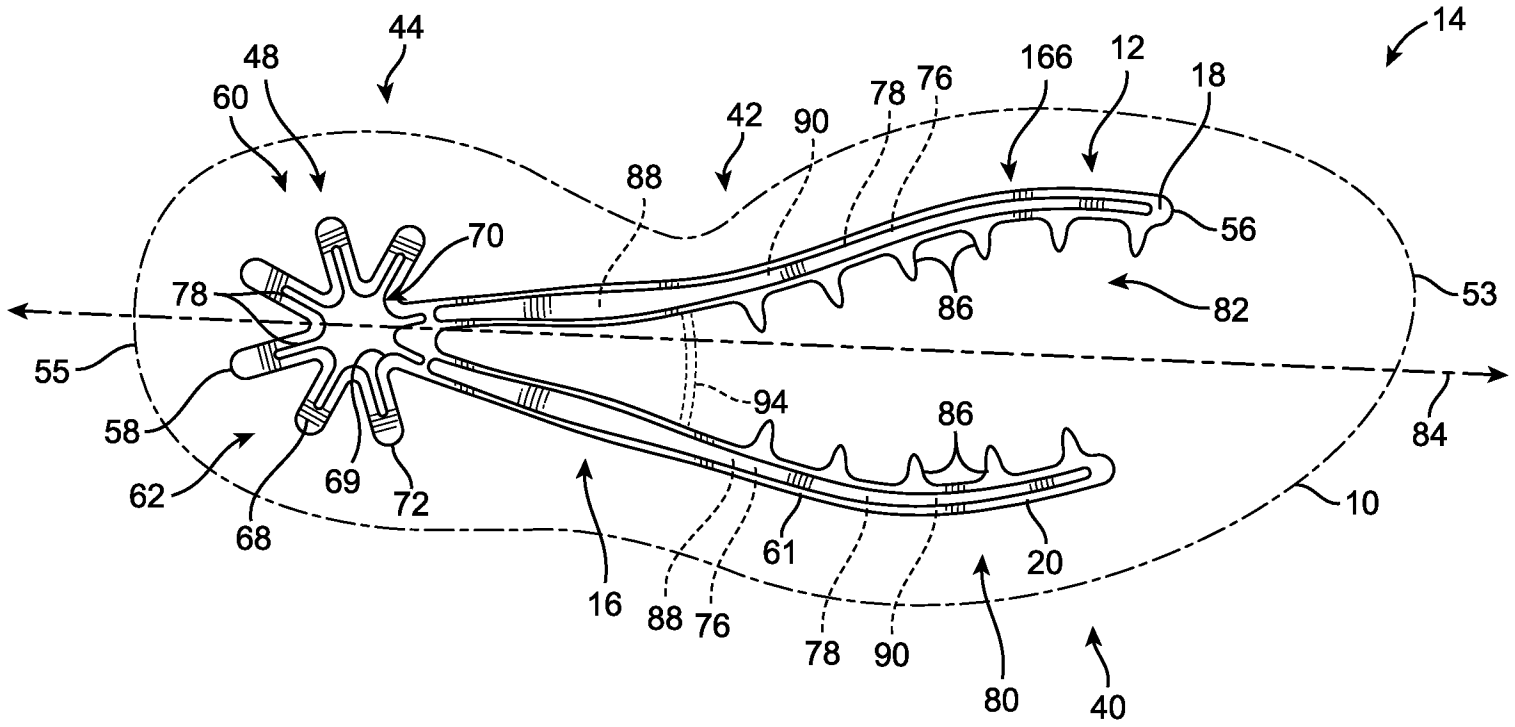
FIG. 10 is a top plan view of another example of a support plate for use in an article of footwear according to the present disclosure, with a schematic representation of a sole assembly of the article of footwear.
Figure 11:
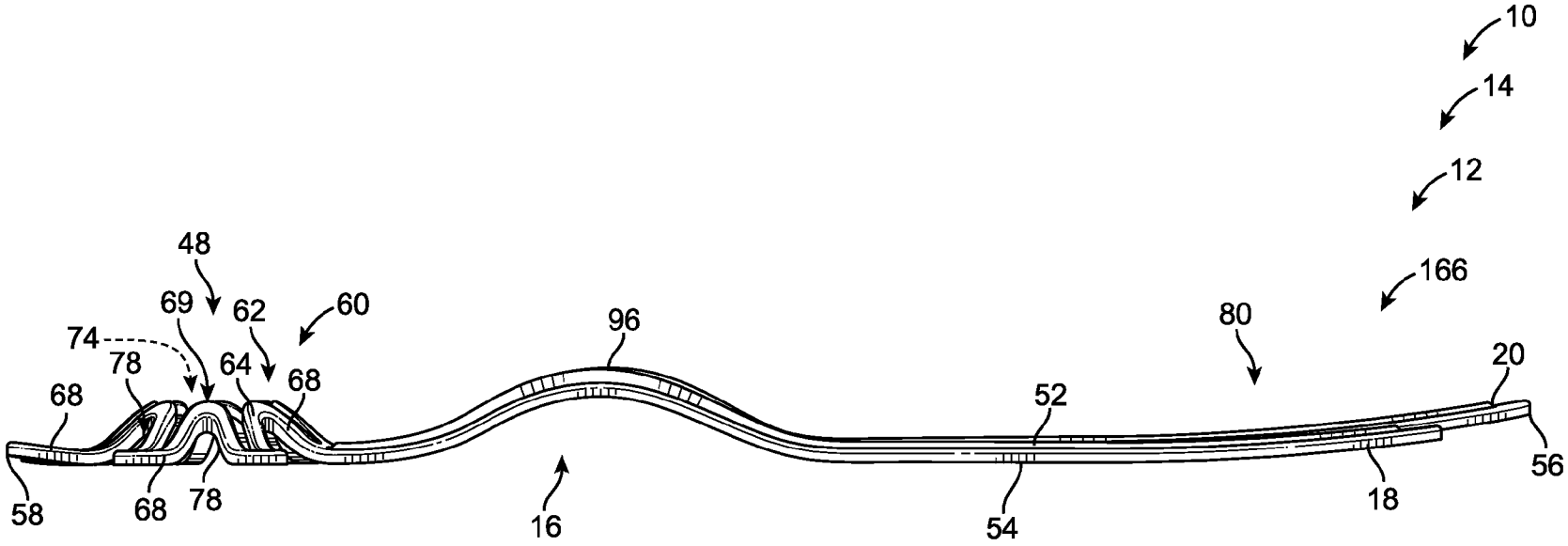
FIG. 11 is a side elevation view of the support plate of FIG. 10.

FIGS. 10-11 illustrate another embodiment according to the present disclosure, support plate 166 (which is an example of support plate 12), shown from the top (FIG. 10) and side (FIG. 11) of support plate 166. FIG. 10 illustrates support plate 166 superimposed on a schematic representation of the outline of article of footwear 10 according to the present disclosure. Medial leg 18 and lateral leg 20 of support plate 166 may branch directly from heel portion 48, such that medial leg 18 and lateral leg 20 form both midfoot portion 16 and forefoot portion 80 of support plate 166. As shown, radially extending arms 68 and flexibility elements 78 may form a continuous, undulating pattern defining circumferential ridge 69 of central heel portion 70. Support plate 166 may include a plurality of centrally extending teeth 86 extending from each of the medial leg 18 and lateral leg 20, towards the longitudinally extending centerline 84.

Figure 12:
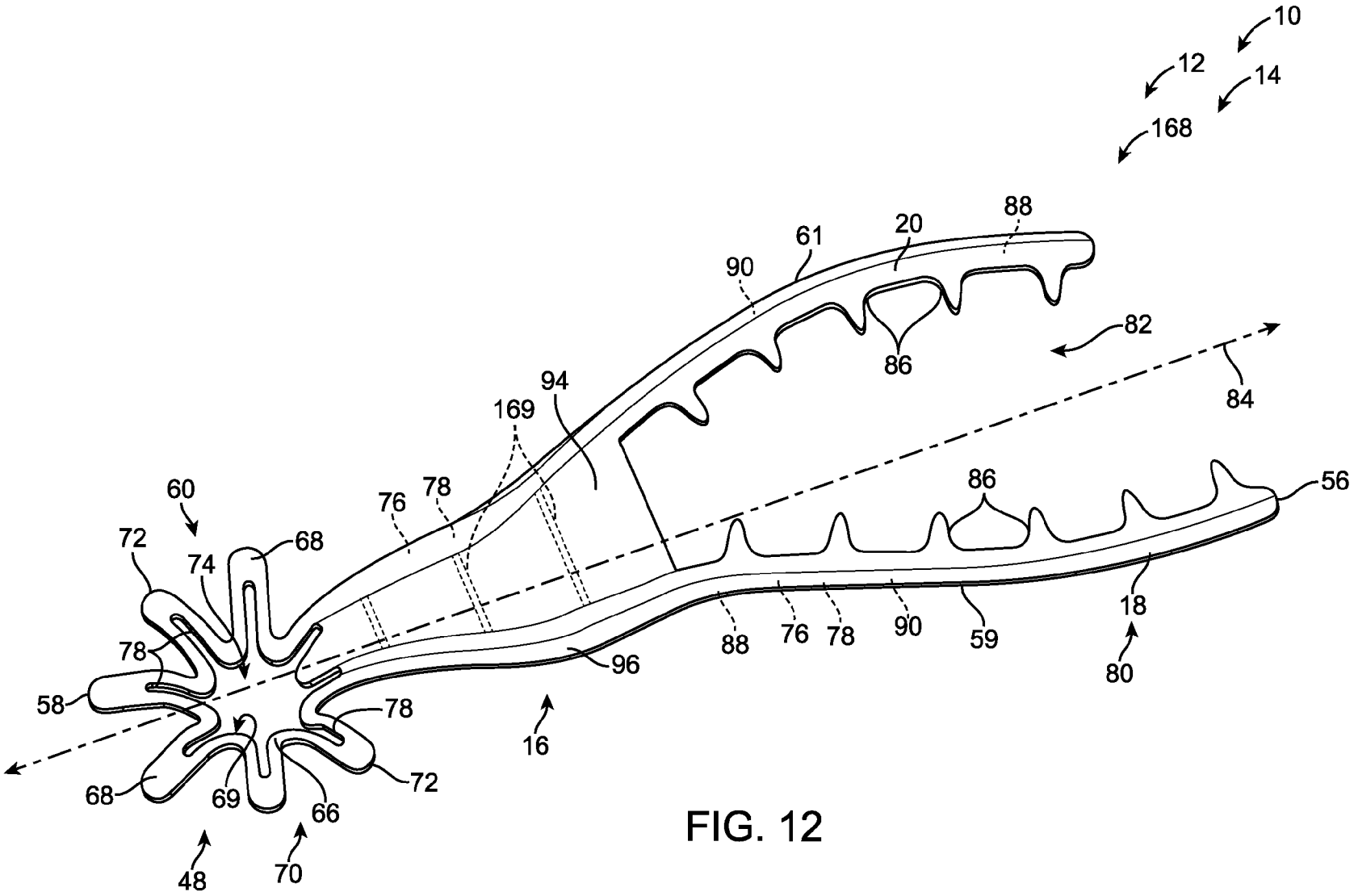
FIG. 12 is a bottom perspective view of another example of a support plate for use in an article of footwear according to the present disclosure.

FIG. 12 illustrates another embodiment according to the present disclosure, support plate 168 (which is an example of support plate 12). Support plate 168 is generally similar to support plate 166 of FIGS. 10-11, except that support plate 168 of FIG. 12 includes a cross-brace 94 connecting medial leg 18 and lateral leg 20, thereby substantially forming a solid plate structure in midfoot portion 16 of support plate 168. By contrast, support plate 166 of FIGS. 10-11 does not include a cross-brace, and open plate space 82 extends all the way through midfoot portion 16 of support plate 166 to heel portion 48. As shown in FIG. 10, at least a portion of open plate space 82 may be substantially triangular. On the other hand, open plate space 82 of support plate 168 of FIG. 12 terminates at the cross-brace 94 and midfoot portion 16 of support plate 168, thus creating an open plate space, at least a portion of which is substantially polygonal. In alternate examples, cross-brace 94 may take the form of two or more smaller (e.g., thinner) cross-braces, rather than a plate-like cross-brace 94 as shown. For example, as indicated in dashed lines, midfoot portion 16 may include a plurality of cross-braces 94, which may be in the form of substantially transverse connections 169 that may extend across longitudinal centerline 84, coupling medial leg 18 and lateral leg 20.

Figure 13:
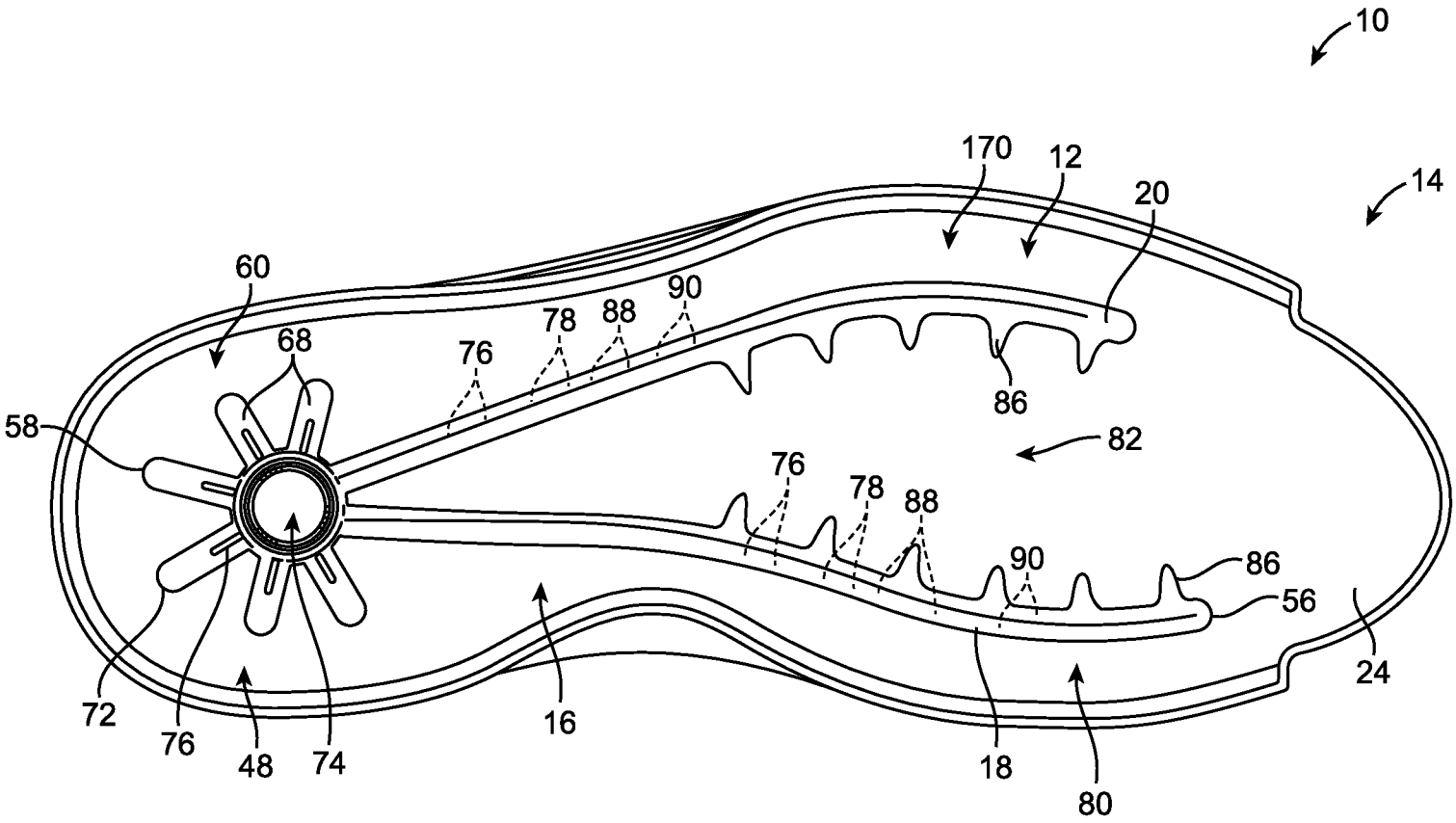
FIG. 13 is a bottom plan view of another example of a support plate for use in an article of footwear according to the present disclosure, shown embedded in a midsole of a sole assembly of an article of footwear.

A number of different examples of support plates 12 have been described herein, with various features and components. Support plates 12 generally include heel portion 48, midfoot portion 16, and forefoot portion 80, wherein the present disclosure has illustrated and described a plurality of variations for each of heel portion 48, midfoot portion 16, and forefoot portion 80. Any of the disclosed heel portions 48 (or variations thereof) may be combined with any of the disclosed midfoot portions 16 (or variations thereof), which may, in turn, be combined with any of the disclosed forefoot portions 80 (or variations thereof) in order to form an integral support plate 12 according to the present disclosure. For example, FIG. 13 illustrates yet another example of support plate 12, in the form of support plate 170. Support plate 170 may essentially be formed by combing forefoot portion 80 and midfoot portion 16 of support plate 166 of FIGS. 10-11 with heel portion 48 of support plate 164 of FIGS. 8-9. Other variations and combinations are also within the scope of the present disclosure.

As used herein, the term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or" clause, whether related or unrelated to those entities specifically identified. Thus, as a non-limiting example, a reference to "A and/or B," when used in conjunction with open-ended language such as "comprising" may refer, in one embodiment, to A only (optionally including entities other than B); in another embodiment, to B only (optionally including entities other than A); in yet another embodiment, to both A and B (optionally including other entities). These entities may refer to elements, actions, structures, steps, operations, values, and the like.

As used herein, the phrase "at least one," in reference to a list of one or more entities should be understood to mean at least one entity selected from any one or more of the entity in the list of entities, but not necessarily including at least one of each and every entity specifically listed within the list of entities and not excluding any combinations of entities in the list of entities. This definition also allows that entities may optionally be present other than the entities specifically identified within the list of entities to which the phrase "at least one" refers, whether related or unrelated to those entities specifically identified. Thus, as a non-limiting example, "at least one of A and B" (or, equivalently, "at least one of A or B," or, equivalently "at least one of A and/or B") may refer, in one embodiment, to at least one, optionally including more than one, A, with no B present (and optionally including entities other than B); in another embodiment, to at least one, optionally including more than one, B, with no A present (and optionally including entities other than A); in yet another embodiment, to at least one, optionally including more than one, A, and at least one, optionally including more than one, B (and optionally including other entities). In other words, the phrases "at least one," "one or more," and "and/or" are open-ended expressions that are both conjunctive and disjunctive in operation. For example, each of the expressions "at least one of A, B and C," "at least one of A, B, or C," "one or more of A, B, and C," "one or more of A, B, or C" and "A, B, and/or C" may mean A alone, B alone, C alone, A and B together, A and C together, B and C together, A, B and C together, and optionally any of the above in combination with at least one other entity.

As used herein, the phrase, "for example," the phrase, "as an example," and/or simply the term "example," when used with reference to one or more components, features, details, structures, embodiments, and/or methods according to the present disclosure, are intended to convey that the described component, feature, detail, structure, embodiment, and/or method is an illustrative, non-exclusive example of components, features, details, structures, embodiments, and/or methods according to the present disclosure. Thus, the described component, feature, detail, structure, embodiment, and/or method is not intended to be limiting, required, or exclusive/exhaustive; and other components, features, details, structures, embodiments, and/or methods, including structurally and/or functionally similar and/or equivalent components, features, details, structures, embodiments, and/or methods, are also within the scope of the present disclosure.

In the event that any patents, patent applications, or other references are incorporated by reference herein and (1) define a term in a manner that is inconsistent with and/or (2) are otherwise inconsistent with, either the non-incorporated portion of the present disclosure or any of the other incorporated references, the non-incorporated portion of the present disclosure shall control, and the term or incorporated disclosure therein shall only control with respect to the reference in which the term is defined and/or the incorporated disclosure was present originally.

As used herein, the terms "selective" and "selectively," when modifying an action, movement, configuration, or other activity of one or more components or characteristics of an apparatus, mean that the specific action, movement, configuration, or other activity is a direct or indirect result of user manipulation of an aspect of, or one or more components of, the apparatus.

As used herein the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It is also within the scope of the present disclosure that elements, components, and/or other recited subject matter that is recited as being adapted to perform a particular function may additionally or alternatively be described as being configured to perform that function, and vice versa.

Examples of footwear, footwear soles, and support plates according to the present disclosure are described in the following enumerated paragraphs:

A1. A support plate for an article of footwear, the support plate comprising:

an upper surface extending from a posterior end of the support plate to an anterior end of the support plate;

a lower surface opposite the upper surface;

a heel portion adjacent the posterior end of the support plate; and a midfoot portion formed integrally with the heel portion, the support plate being configured to be at least partially embedded within a sole assembly of the article of footwear such that the heel portion of the support plate is generally positioned under a heel of a wearer's foot, and such that the midfoot portion of the support plate is generally positioned under a midfoot region of the wearer's foot.

A1.1. The support plate of paragraph A1, wherein the support plate is configured such that it is positioned with respect to the article of footwear such that the upper surface faces the bottom of the wearer's foot when the article of footwear is worn, and such that the lower surface of the support plate faces a surface on which the wearer is walking or standing.

A2. The support plate of paragraph A1 or A1.1, wherein the heel portion is a cushioning heel portion.

A3. The support plate of any of paragraphs A1-A2, wherein the heel portion comprises a domed structure, the domed structure comprising a convex surface and a concave surface opposite the convex surface.

A4. The support plate of paragraph A3, wherein the domed structure is oriented such that a heel strike by the heel of a wearer of the article of footwear exerts a force on the convex surface of the domed structure.

A5. The support plate of paragraph A4, wherein the convex surface is configured to resiliently compress upon exertion of the force on the convex surface.

A6. The support plate of any of paragraphs A3-A5, wherein the domed structure comprises a plurality of radially extending arms, each extending from a central heel region of the heel portion towards a respective peripheral end of the respective radially extending arm.

A7. The support plate of paragraph A6, wherein the central heel region comprises a through-hole extending from the upper surface to the lower surface of the support plate.

A8. The support plate of any of paragraphs A6-A7, wherein the plurality of radially extending arms comprises at least two, at least three, at least four, at least five, at least six, at least seven, at least eight, at least nine, or at least ten radially extending arms.

A9. The support plate of any of paragraphs A6-A8, wherein at least one of the plurality of radially extending arms comprises a reinforcing element, and optionally wherein each of the plurality of radially extending arms includes a reinforcing element.

A10. The support plate of paragraph A9, wherein each respective reinforcing element projects from a respective radially extending arm, away from an outsole of the sole assembly.

A11. The support plate of any of paragraphs A6-A10, wherein at least one of the plurality of radially extending arms comprises a slot formed therein.

A12. The support plate of any of paragraphs A6-A11, wherein each of the plurality of radially extending arms comprises a respective slot formed therein to facilitate greater resilient compression of the domed portion than a domed portion with a plurality of radially extending arms that do not include respective slots formed therein.

A13. The support plate of paragraph A11 or A12, wherein each of the slots extends from the central heel region of the support plate towards a respective peripheral end of a respective radially extending arm.

A14. The support plate of paragraph A13, wherein a respective slot length of each of the slots is less than a respective arm length of the respective radially extending arm.

A15. The support plate of any of paragraphs A11-A14, wherein each slot extends from a/the through-hole of the central heel region such that the through-hole continues into a portion of each of the radially extending arms.

A16. The support plate of any of paragraphs A6-A15, wherein the plurality of radially extending arms forms a continuous, undulating pattern surrounding the central heel region.

A16.1. The support plate of any of paragraphs A6-A16, wherein the midfoot portion of the support plate extends from a/the through-hole of the central heel region.

A17. The support plate of any of paragraphs A1-A16.1, further comprising a medial leg and a lateral leg, each of the medial leg and the lateral leg being formed integrally with the heel portion and the midfoot portion, wherein the medial leg and the lateral leg each extend longitudinally from the midfoot portion towards the anterior end of the support plate.

A18. The support plate of paragraph A17, wherein at least a portion of the medial leg is positioned to underlie the medial side of the wearer's foot when the article of footwear is worn.

A19. The support plate of paragraph A17 or A18, wherein at least a portion of the lateral leg is positioned to underlie the lateral side of the wearer's foot when the article of footwear is worn.

A20. The support plate of any of paragraphs A17-19, wherein the medial leg and the lateral leg branch out from the midfoot portion of the support plate, such that an open plate space is formed between the medial leg and the lateral leg.

A20.1. The support plate of paragraph A20, wherein the open plate space extends from the midfoot portion of the support plate to the anterior end of the support plate.

A20.2. The support plate of any of paragraphs A20-A20.1, wherein at least a portion of the open plate space is substantially triangular.

A20.3. The support plate of any of paragraphs A20-A20.2, wherein at least a portion of the open plate space is substantially polygonal.

A20.4. The support plate of any of paragraphs A20-A20.3, wherein at least a portion of the open plate space is irregularly shaped.

A20.5. The support plate of any of paragraphs A20-A20.4, wherein at least a portion of the open plate space is positioned between a longitudinal centerline of the support plate and a medial edge of the support plate.

A20.6. The support plate of any of paragraphs A20-A20.5, wherein at least a portion of the open plate space is positioned between a/the longitudinal centerline of the support plate and a lateral edge of the support plate.

A20.7. The support plate of any of paragraphs A20-A20.6, wherein at least a portion of the open plate space is curved.

A20.8. The support plate of any of paragraphs A20-A20.7, wherein the open plate space defines a gap between the medial leg and the lateral leg such that the gap sequentially extends across opposed sides of a/the longitudinal centerline of the support plate A20.9. The support plate of any of paragraphs A20-A20.8, wherein at least a portion of the open plate space winds around one or more features of the medial leg and the lateral leg.

A20.10. The support plate of any of paragraphs A17-A20.9, wherein the anterior end of the support plate is defined by the medial leg of the support plate, and wherein a portion of the medial leg adjacent the anterior end of the support plate is configured to underlie an area of the wearer's foot adjacent the hallux (big toe) of the wearer's foot.

A21. The support plate of any of paragraphs A17-A20.1, wherein the medial leg extends from the midfoot portion to the anterior end of the support plate.

A22. The support plate of any of paragraphs A17-A21, wherein a portion of the medial leg is configured to underlie the hallux of the wearer's foot.

A23. The support plate of any of paragraphs A17-A22, wherein a portion of the lateral leg is configured to underlie at least one of the toes of the wearer's foot.

A24. The support plate of any of paragraphs A17-A23, wherein a portion of the medial leg is configured to underlie the ball of the wearer's foot, adjacent the hallux of the wearer's foot.

A25. The support plate of any of paragraphs A17-A24, wherein a portion of the lateral leg is configured to underlie the ball of the wearer's foot, adjacent at least one of the toes of the wearer's foot.

A26. The support plate of any of paragraphs A17-A25, wherein the medial leg comprises a first portion adjacent a/the medial edge of the support plate, and a second portion that extends towards a/the lateral edge of the support plate, past a/the longitudinal centerline of the support plate.

A26.1. The support plate of paragraph A26, wherein at least one of the medial leg and the lateral leg is/are configured to provide rock protection to the wearer's foot.

A26.2. The support plate of any of paragraphs A26-A26.1, wherein, as the medial leg extends from the midfoot portion, the medial leg diverges from the lateral leg towards the medial edge of the support plate, and then changes direction to extend towards the lateral edge of the support plate.

A26.3. The support plate of any of paragraphs A17-A26.2, wherein the lateral leg comprises a portion that extends towards a/the medial edge of the support plate, across a/the longitudinal centerline of the support plate.

A26.4. The support plate of any of paragraphs A26-A26.3, wherein the lateral leg is shaped to receive a/the portion of the medial leg that extends across the longitudinal centerline of the support plate.

A26.5. The support plate of any of paragraphs A26-A26.4, wherein at least one of the medial leg and the lateral leg include a plurality of portions that extend across the longitudinal centerline of the support plate.

A26.6. The support plate of paragraph A26.5, wherein the plurality of portions are separated by portions of the respective lateral leg or medial leg that do not extend across the longitudinal centerline of the support plate.

A27. The support plate of any of paragraphs A17-A26.6, wherein the medial leg comprises a plurality of centrally extending teeth extending towards a/the longitudinal centerline of the support plate.

A28. The support plate of any of paragraphs A17-A27, wherein the lateral leg comprises a plurality of centrally extending teeth extending towards a/the longitudinal centerline of the support plate.

A29. The support plate of any of paragraphs A17-A28, further comprising at least one rib extending from at least one of the upper surface and the lower surface of the support plate, each of the at least one ribs corresponding to an area of increased stiffness of the support plate.

A29.1. The support plate of paragraph A29, wherein the medial leg comprises at least one of the at least one ribs, corresponding to an area of increased thickness of the medial leg.

A30. The support plate of paragraph A29 or A29.1, wherein at least one of the at least one ribs is formed on an upper surface of the medial leg.

A31. The support plate of any of paragraphs A29-A30, wherein at least one of the at least one ribs is formed on a lower surface of the medial leg.

A32. The support plate of any of paragraphs A29-A31, wherein the lateral leg comprises at least one of the at least one ribs, corresponding to an area of increased thickness of the lateral leg.

A33. The support plate of any of paragraphs A29-A32, wherein at least one of the at least one ribs is formed on an upper surface of the lateral leg.

A34. The support plate of any of paragraphs A29-A33, wherein at least one of the at least one ribs is formed on a lower surface of the lateral leg.

A34.1. The support plate of any of paragraphs A29-A34, wherein the at least one rib is configured to reinforce the support plate.

A34.2. The support plate of any of paragraphs A29-A34.1, wherein the at least one rib comprises an area of increased thickness projecting from the upper surface of the support plate.

A34.3. The support plate of any of paragraphs A29-A34.2, wherein the at least one rib extends along portions of the midfoot portion of the support plate toward the anterior end of the support plate.

A34.4. The support plate of paragraph A34.3, wherein the at least one rib has a greater thickness in the midfoot portion of the support plate than in a region of the support plate closer to the anterior end of the support plate.

A35. The support plate of any of paragraphs A17-A34.4, further comprising at least one groove, each of the at least one grooves corresponding to an area of increased flexibility of the support plate.

A35.1 The support plate of paragraph A35, wherein the medial leg comprises at least one of the at least one grooves, corresponding to an area of decreased thickness of the medial leg.

A36. The support plate of paragraph A35 or A35.1, wherein at least one of the at least one grooves is formed on an/the upper surface of the medial leg.

A37. The support plate of any of paragraphs A35-A36, wherein at least one of the at least one grooves is formed on a/the lower surface of the medial leg.

A38. The support plate of any of paragraphs A35-A37, wherein the lateral leg comprises at least one of the at least one grooves, corresponding to an area of decreased thickness of the lateral leg.

A39. The support plate of paragraph A38, wherein at least one of the at least one grooves is formed on an/the upper surface of the lateral leg.

A40. The support plate of paragraph A38 or A39, wherein at least one of the at least one grooves is formed on a/the lower surface of the lateral leg.

A41. The support plate of any of paragraphs A35-A40, wherein the at least one groove is configured to increase movement of the support plate.

A41.1. The support plate of any of paragraphs A35-A41, wherein the at least one groove comprises an area of decreased thickness of the support plate.

A42. The support plate of any of paragraphs A17-A41.1, wherein the medial leg comprises at least one projection formed thereon, the at least one projection being configured for alignment and placement of the support plate with respect to the article of footwear, and optionally with respect to an outside of the sole assembly.

A42.1. The support plate of paragraph A42, wherein each of the at least one projection is configured to be received within a corresponding aperture in the outsole.

A43. The support plate of any of paragraphs A17-A42.1, wherein the lateral leg comprises at least one projection formed thereon, the at least one projection being configured for alignment and placement of the support plate with respect to the article of footwear, and optionally with respect to an/the outside of the sole assembly.

A43.1. The support plate of paragraph A43, wherein each of the at least one projection is configured to be received within a corresponding aperture in the outsole.

A44. The support plate of any of paragraphs A17-A43.1, wherein the medial leg and the lateral leg have a greater stiffness than the heel portion of the support plate.

A45. The support plate of any of paragraphs A17-A43.1, wherein the medial leg and the lateral leg have a lesser stiffness than the heel portion of the support plate.

A46. The support plate of any of paragraphs A17-A43.1, wherein the medial leg and the lateral leg have a stiffness approximately equal to that of the heel portion of the support plate.

A47. The support plate of any of paragraphs A17-A46, further comprising at least one cross-brace extending substantially transversely across a/the longitudinal centerline of the support plate, each of the at least one cross-braces being coupled to both the medial leg and the lateral leg.

A48. The support plate of any of paragraphs A1-A47, wherein the midfoot portion comprises an arch support portion that is configured to underlie an arch of the wearer's foot.

A48.1. The support plate of paragraph A48, wherein the arch support portion is arched away from the anterior and posterior ends of the support plate.

A48.2. The support plate of any of paragraphs A48-A48.1, wherein the arch support portion has a concave configuration relative to an/the outsole.

A49. The support plate of any of paragraphs A48-A48,2, wherein the arch support portion is configured to resiliently compress under the weight of the wearer during a gait of the wearer.

A50. The support plate of any of paragraphs A48-A49, wherein the arch support portion is configured to deflect under the weight of the wearer such that a lower surface of the arch support portion is pressed, from a resting form, towards an/the outsole of the article of footwear, and wherein the arch support portion is configured to return to its resting form when the weight is removed, such that a return force is created towards an upper surface of the arch support portion.

A51. The support plate of any of paragraphs A48-A50, wherein the arch support portion is curved to conform to the arch of the wearer's foot.

A52. The support plate of any of paragraphs A1-A51, wherein the support plate is configured to provide energy return, such that at least a portion of an impact force transferred from the wearer to the support plate is returned to the wearer from the support plate, in order to push and/or urge the wearer's foot up and/or forward.

A53. The support plate of paragraph A52, wherein the support plate is configured to resiliently deform in response to a force on the sole assembly during a stride of the wearer and resiliently recover in response to the force being removed from the sole assembly.

A54. The support plate of any of paragraphs A52-A53, wherein the support plate is configured to store energy during a portion of a/the stride of the wearer and release the energy at a different portion of the stride of the wearer.

A55. The support plate of any of paragraphs A1-A54, wherein the anterior end of the support plate is positioned under a forefoot region of the wearer's foot when the article of footwear is worn.

A56. The support plate of any of paragraphs A1-A55, wherein the anterior end of the support plate is positioned under a portion of at least one of the toes of the wearer's foot, such that the support plate extends along substantially the entire length of the article of footwear.

A57. The support plate of any of paragraphs A1-A56, wherein the support plate is configured to be embedded within a midsole of the sole assembly of the article of footwear.

A58. The support plate of any of paragraphs A1-A57, wherein the support plate is configured to be positioned between a/the midsole of the article of footwear and an/the outsole of the article of footwear.

A59. The support plate of any of paragraphs A1-A58, wherein the support plate is at least partially visible when incorporated into the article of footwear.

A59.1 The support plate of paragraph A59, wherein the support plate is at least partially visible through an/the outsole of the sole assembly.

A60. The support plate of any of paragraphs A1-A59.1, wherein the support plate is injection molded.

A60.1. The support plate of any of paragraphs A1-A60, wherein the support plate is thermoformed.

A61. The support plate of any of paragraphs A1-A60.1, wherein the support plate comprises at least one of carbon fiber, a composite material, polyvinyl alcohol, nylon-6, thermoplastic polyurethane, and nylon.

A62. The support plate of any of paragraphs A1-A61, wherein the support plate has a width defined between a/the medial edge and a/the lateral edge of the support plate, wherein the width of the support plate varies along the length of the support plate from the posterior end to the anterior end.

A63. The support plate of any of paragraphs A1-A62, wherein the support plate has a thickness defined as a distance between the upper surface and the lower surface of the support plate, perpendicular to the upper surface and lower surface.

A64. The support plate of paragraph A63, wherein the thickness varies along the length of the support plate from the posterior end to the anterior end.

A65. The support plate of any of paragraphs A63-A64, wherein a/the arch support portion has an increased thickness as compared to at least one other area of the support plate.

A66. The support plate of any of paragraphs A63-A65, wherein the heel portion has an increased thickness as compared to at least one other area of the support plate.

A67. The support plate of any of paragraphs A1-A66, wherein the support plate is formed from a dual density material such that different areas of the support plate have different densities than other areas of the support plate.

A67.1. The support plate of paragraph A67, wherein the midfoot portion has a greater density than the heel portion.

A67.2. The support plate of paragraph A67 or A67.1, wherein a/the medial leg extending from the midfoot portion of the support plate has a greater density than the heel portion.

A67.3. The support plate of any of paragraphs A67-A67.2, wherein a/the lateral leg extending from the midfoot portion of the support plate has a greater density than the heel portion.

A68. The support plate of any of paragraphs A1-A67.3, wherein at least a portion of the support plate extends through at least a portion of an/the outsole of the sole assembly.

B1. An article of footwear, comprising:

an upper configured to engage with a wearer's foot when the footwear is worn by the wearer;

a sole assembly coupled to the upper, the sole assembly comprising a midsole and an outsole, the outsole having an outer surface that is configured to engage with a surface on which the wearer is striding, and the outsole having an inner surface configured to engage with the midsole; and the support plate of any of paragraphs A1-A68, wherein the support plate is incorporated within the sole assembly.

B2. The article of footwear of paragraph B1, wherein the support plate is at least partially, and optionally completely, embedded in the midsole.

B3. The article of footwear of any of paragraphs B1-B2, wherein the support plate is positioned between the midsole and the inner surface of the outsole.

B4. The article of footwear of any of paragraphs B1-B3, wherein at least a portion of the support plate is covered by the outsole such that it is not visible from the outer surface of the outsole.

B5. The article of footwear of any of paragraphs B1-B4, wherein at least a portion of the support plate is visible from the outer surface of the outsole.

B6. The article of footwear of any of paragraphs B1-B5, wherein at least a portion of the support plate at least partially extends through the outsole, from the inner surface of the outsole towards the outer surface of the outsole.

B7. The article of footwear of paragraph B6, wherein at least a portion of the support plate extends through the outsole, from the inner surface of the outsole to the outer surface of the outsole.

B8. The article of footwear of any of paragraphs B1-B7, wherein the article of footwear comprises a boot.

B9. The article of footwear of paragraph B8, wherein the boot comprises a projecting heel.

B9.1. The article of footwear of paragraph B8 or B9, wherein the outsole comprises a/the projecting heel.

B10. The article of footwear of any of paragraphs B1-B7, wherein the article of footwear comprises at least one of an athletic shoe, a casual shoe, and an outdoor shoe.

B11. The article of footwear of any of paragraphs B1-B10, wherein a midsole heel region of the midsole of the article of footwear is positioned above the heel portion of the support plate, such that the heel portion of the support plate is positioned between the midsole heel region and the outsole.

B11.1 The article of footwear of paragraph B11, wherein the midsole heel region is sufficiently compliant that it conveys force from a heel strike by the wearer of the article of footwear to the heel portion of the support plate, and optionally when dependent on any of paragraphs A3-A16.1, to the domed structure.

B12. The article of footwear of any of paragraphs B11-B11.1, wherein the midsole heel region has a different compliance than other areas of the midsole.

B13. The article of footwear of paragraph B12, wherein the midsole heel region is more compliant than at least one other area of the midsole.

B14. The article of footwear of any of paragraphs B11-B13, wherein the midsole heel region comprises at least one of a gel and a foam.

B15. The article of footwear of any of paragraphs B1-B14, wherein the midsole comprises a/the midsole heel region in which the heel portion of the support plate is at least partially embedded.

C1. A sole assembly for an article of footwear, the sole assembly comprising:

a midsole portion;

an outsole portion coupled to the midsole portion, the outsole portion comprising an inner surface positioned adjacent the midsole portion, and the outsole portion further comprising an outer surface opposite the inner surface; and the support plate of any of paragraphs A1-A68.

C2. The sole assembly of paragraph C1, wherein the support plate is positioned between the midsole portion and the inner surface of the outsole portion.

C3. The sole assembly of any of paragraphs C1-C2, wherein the support plate is at least partially, and optionally completely, embedded within the midsole portion.

C4. The sole assembly of any of paragraphs C1-C3, wherein the support plate is at least partially visible from the outer surface of the outsole portion.

C4.1. The sole assembly of any of paragraphs C1-C4, wherein a portion of the support plate extends at least partially through the outsole portion, from the inner surface of the outsole portion towards the outer surface of the outsole portion.

C4.2. The sole assembly of any of paragraphs C1-C4.1, wherein a portion of the support plate extends through the outsole portion, from the inner surface of the outsole portion to the outer surface of the outsole portion.

C5. The sole assembly of any of paragraphs C1-C4.2, further comprising an insole portion configured to engage with the midsole portion and with a wearer's foot.

C6. An article of footwear comprising the sole assembly of any of paragraphs C1-C5.

The various disclosed elements of footwear, footwear soles, and support plates disclosed herein are not required to all footwear, footwear soles, and support plates according to the present disclosure, and the present disclosure includes all novel and non-obvious combinations and subcombinations of the various elements disclosed herein. Moreover, one or more of the various elements disclosed herein may define independent inventive subject matter that is separate and apart from the whole of a disclosed article of footwear, footwear sole, and/or support plate. Accordingly, such inventive subject matter is not required to be associated with the specific footwear, footwear soles, and support plates that are expressly disclosed herein, and such inventive subject matter may find utility in footwear, footwear soles, and support plates that are not expressly disclosed herein.

INDUSTRIAL APPLICABILITY

The footwear, footwear soles, and support plates disclosed herein are applicable to the footwear industry.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower, or equal in scope to the original claims, are also regarded as included within the subject matter of the inventions of the present disclosure.

The invention claimed is:

1. An article of footwear, comprising:

an upper configured to engage with a wearer's foot when the article of footwear is worn on the wearer's foot;

a sole assembly coupled to the upper, the sole assembly comprising a midsole and an outsole, the outsole having an outer surface that is configured to engage with a surface on which the wearer is striding; and a support plate embedded within the sole assembly, the support plate comprising:

an upper surface extending from a posterior end of the support plate to an anterior end of the support plate;

a lower surface opposite the upper surface;

a cushioning heel portion adjacent the posterior end of the support plate, wherein the cushioning heel portion is configured to resiliently compress in response to a heel strike by the wearer; wherein the cushioning heel portion comprises a domed structure, the domed structure comprising a convex surface that forms a portion of the upper surface of the support plate and a concave surface that is opposite the convex surface and forms a portion of the lower surface of the support plate, wherein the domed structure is oriented such that a heel strike by the wearer of the article of footwear exerts a force on the convex surface of the domed structure, and wherein the convex surface is configured to resiliently compress upon exertion of the force on the convex surface; wherein the domed structure comprises a plurality of radially extending arms each extending from a central heel region of the cushioning heel portion towards a respective peripheral end of the respective radially extending arm, wherein the central heel region of the domed structure defines a circumferential ridge of the domed structure, and further wherein the plurality of radially extending arms extends radially outward from the circumferential ridge and toward the outsole to elevate the circumferential ridge above the outsole;

a midfoot portion formed integrally with the cushioning heel portion, the midfoot portion comprising an arch support portion that is curved to support an arch of the wearer's foot;

a medial leg formed integrally with the cushioning heel portion and the midfoot portion; and a lateral leg formed integrally with the cushioning heel portion and the midfoot portion, wherein the medial leg and the lateral leg each extend longitudinally from the midfoot portion towards the anterior end of the support plate.

2. The article of footwear according to claim 1, wherein the support plate is at least partially embedded in the midsole of the sole assembly.

3. The article of footwear according to claim 1, wherein the support plate is positioned between the midsole and the outsole of the sole assembly.

4. The article of footwear according to claim 1, wherein a first portion of the support plate is covered by the outsole such that it is not visible from the outer surface of the outsole, and wherein a second portion of the support plate is visible from the outer surface of the outsole.

5. The article of footwear according to claim 1, wherein the support plate is embedded within the sole assembly such that the cushioning heel portion of the support plate is generally positioned under a heel of the wearer's foot, and such that the midfoot portion of the support plate is generally positioned under a midfoot region of the wearer's foot when the article of footwear is worn.

6. The article of footwear according to claim 1, wherein the support plate is configured to provide energy return during a stride of the wearer of the article of footwear, such that at least a portion of an impact force transferred from the wearer to the support plate is returned to the wearer from the support plate, in order to urge the wearer's foot at least one of up and forward.

7. The article of footwear according to claim 1, wherein the midsole comprises a midsole heel region in which the cushioning heel portion of the support plate is at least partially embedded.

8. The article of footwear according to claim 7, wherein the midsole heel region is sufficiently compliant to convey the force from the heel strike by the wearer of the article of footwear to the domed structure of the cushioning heel portion of the support plate.

9. The article of footwear according to claim 8, wherein the midsole heel region of the midsole is more compliant than at least one other area of the midsole.

10. The article of footwear according to claim 8, wherein the midsole heel region of the midsole comprises at least one of a gel and a foam.

11. The article of footwear according to claim 1, wherein the central heel region comprises a through-hole extending from the upper surface to the lower surface of the support plate.

12. The article of footwear according to claim 11, wherein at least one of the plurality of radially extending arms comprises a slot formed therein, wherein each of the slots extends from the through-hole of the central heel region of the support plate towards the respective peripheral end of the respective radially extending arm.

13. The article of footwear according to claim 12, wherein the plurality of radially extending arms forms a continuous, undulating pattern surrounding the central heel region.

14. The article of footwear according to claim 1, wherein the midfoot portion of the support plate extends from the circumferential ridge of the central heel region.

15. The article of footwear according to claim 1, wherein at least a portion of the medial leg of the support plate is positioned to underlie a medial portion of the wearer's foot when the article of footwear is worn, and wherein at least a portion of the lateral leg is positioned to underlie a lateral portion of the wearer's foot when the article of footwear is worn.

16. The article of footwear according to claim 1, wherein the medial leg and the lateral leg branch out from the midfoot portion of the support plate, such that an open plate space is formed between the medial leg and the lateral leg.

17. The article of footwear according to claim 1, wherein the anterior end of the support plate is defined by the medial leg of the support plate, and wherein a portion of the medial leg adjacent the anterior end of the support plate is configured to underlie an area of the wearer's foot adjacent a hallux of the wearer's foot.

18. The article of footwear according to claim 1, wherein the medial leg comprises a first portion adjacent a medial edge of the support plate, and a second portion that extends towards a lateral edge of the support plate, past a longitudinal centerline of the support plate, and further wherein the lateral leg comprises a first portion adjacent the lateral edge of the support plate, and a second portion that extends towards the medial edge of the support plate, past the longitudinal centerline of the support plate.

19. The article of footwear according to claim 1, wherein the support plate further comprises at least one cross-brace extending substantially transversely across a longitudinal centerline of the support plate, each of the at least one cross-braces being coupled to both the medial leg and the lateral leg.

20. The article of footwear according to claim 1, wherein the support plate further comprises at least one rib, each of the at least one ribs corresponding to an area of increased stiffness of the support plate, wherein the at least one rib comprises an area of increased thickness projecting from the upper surface of the support plate.

21. The article of footwear according to claim 1, wherein the support plate further comprises at least one groove, each of the at least one grooves corresponding to an area of increased flexibility of the support plate, wherein the at least one groove comprises an area of decreased thickness of the support plate.

22. The article of footwear according to claim 1, wherein the article of footwear comprises a boot.

23. The article of footwear according to claim 22, wherein the outsole comprises a projecting heel.

24. The article of footwear according to claim 1, wherein the medial leg and the lateral leg branch out from the midfoot portion of the support plate, and diverge from each other such that an open plate space is formed between the medial leg and the lateral leg.

25. The article of footwear according to claim 1, wherein the medial leg and the lateral leg diverge away from each other and converge towards each other as they extend from the midfoot portion of the support plate.

26. The article of footwear according to claim 1, wherein the medial leg and the lateral leg together underlie a significant portion of the wearer's midfoot and forefoot when the article of footwear is worn, and wherein a first portion of the lateral leg is sized and shaped to receive a second portion of the medial leg that extends across a longitudinal centerline of the support plate, towards a lateral edge of the support plate.

27. The article of footwear according to claim 1, wherein the arch support portion is arched away from the anterior and posterior ends of the support plate such that it has a concave configuration relative to the outsole and extends in a different plane than the anterior and posterior ends of the support plate, and wherein the arch support portion is curved to conform to the arch of the wearer's foot when the article of footwear is worn.

28. An article of footwear, comprising:

an upper configured to engage with a wearer's foot when the article of footwear is worn on the wearer's foot;

a sole assembly coupled to the upper, the sole assembly comprising a midsole and an outsole, the outsole having an outer surface that is configured to engage with a surface on which the wearer is striding; and a support plate embedded within the sole assembly, the support plate comprising:

an upper surface extending from a posterior end of the support plate to an anterior end of the support plate;

a lower surface opposite the upper surface;

a cushioning heel portion adjacent the posterior end of the support plate, wherein the cushioning heel portion is configured to resiliently compress in response to a heel strike by the wearer; wherein the cushioning heel portion comprises a domed structure, the domed structure comprising a convex surface that forms a portion of the upper surface of the support plate and a concave surface that is opposite the convex surface and forms a portion of the lower surface of the support plate, wherein the domed structure is oriented such that a heel strike by the wearer of the article of footwear exerts a force on the convex surface of the domed structure, and wherein the convex surface is configured to resiliently compress upon exertion of the force on the convex surface;

a midfoot portion formed integrally with the cushioning heel portion, the midfoot portion comprising an arch support portion that is curved to support an arch of the wearer's foot;

a medial leg formed integrally with the cushioning heel portion and the midfoot portion; and a lateral leg formed integrally with the cushioning heel portion and the midfoot portion; wherein the medial leg and the lateral leg each extend longitudinally from the midfoot portion towards the anterior end of the support plate; wherein the medial leg comprises a first portion adjacent a medial edge of the support plate, and a second portion that extends towards a lateral edge of the support plate, past a longitudinal centerline of the support plate; and further wherein the lateral leg comprises a first portion adjacent the lateral edge of the support plate, and a second portion that extends towards the medial edge of the support plate, past the longitudinal centerline of the support plate.

29. The article of footwear according to claim 28, wherein the support plate is at least partially embedded in the midsole of the sole assembly.

30. The article of footwear according to claim 28, wherein the support plate is positioned between the midsole and the outsole of the sole assembly.

31. The article of footwear according to claim 28, wherein a first portion of the support plate is covered by the outsole such that it is not visible from the outer surface of the outsole, and wherein a second portion of the support plate is visible from the outer surface of the outsole.

32. The article of footwear according to claim 28, wherein the support plate is embedded within the sole assembly such that the cushioning heel portion of the support plate is generally positioned under a heel of the wearer's foot, and such that the midfoot portion of the support plate is generally positioned under a midfoot region of the wearer's foot when the article of footwear is worn.

33. The article of footwear according to claim 28, wherein the support plate is configured to provide energy return during a stride of the wearer of the article of footwear, such that at least a portion of an impact force transferred from the wearer to the support plate is returned to the wearer from the support plate, in order to urge the wearer's foot at least one of up and forward.

34. The article of footwear according to claim 28, wherein the midsole comprises a midsole heel region in which the cushioning heel portion of the support plate is at least partially embedded.

35. The article of footwear according to claim 34, wherein the midsole heel region is sufficiently compliant to convey the force from the heel strike by the wearer of the article of footwear to the domed structure of the cushioning heel portion of the support plate.

36. The article of footwear according to claim 35, wherein the midsole heel region of the midsole is more compliant than at least one other area of the midsole.

37. The article of footwear according to claim 35, wherein the midsole heel region of the midsole comprises at least one of a gel and a foam.

38. The article of footwear according to claim 28, wherein at least a portion of the medial leg of the support plate is positioned to underlie a medial portion of the wearer's foot when the article of footwear is worn, and wherein at least a portion of the lateral leg is positioned to underlie a lateral portion of the wearer's foot when the article of footwear is worn.

39. The article of footwear according to claim 28, wherein the medial leg and the lateral leg branch out from the midfoot portion of the support plate, such that an open plate space is formed between the medial leg and the lateral leg.

40. The article of footwear according to claim 28, wherein the anterior end of the support plate is defined by the medial leg of the support plate, and wherein a portion of the medial leg adjacent the anterior end of the support plate is configured to underlie an area of the wearer's foot adjacent a hallux of the wearer's foot.

41. The article of footwear according to claim 28, wherein the support plate further comprises at least one cross-brace extending substantially transversely across a longitudinal centerline of the support plate, each of the at least one cross-braces being coupled to both the medial leg and the lateral leg.

42. The article of footwear according to claim 28, wherein the support plate further comprises at least one rib, each of the at least one ribs corresponding to an area of increased stiffness of the support plate, wherein the at least one rib comprises an area of increased thickness projecting from the upper surface of the support plate.

43. The article of footwear according to claim 28, wherein the support plate further comprises at least one groove, each of the at least one grooves corresponding to an area of increased flexibility of the support plate, wherein the at least one groove comprises an area of decreased thickness of the support plate.

44. The article of footwear according to claim 28, wherein the article of footwear comprises a boot.

45. The article of footwear according to claim 44, wherein the outsole comprises a projecting heel.

46. The article of footwear according to claim 28, wherein the medial leg and the lateral leg branch out from the midfoot portion of the support plate, and diverge from each other such that an open plate space is formed between the medial leg and the lateral leg.

47. The article of footwear according to claim 28, wherein the medial leg and the lateral leg diverge away from each other and converge towards each other as they extend from the midfoot portion of the support plate.

48. The article of footwear according to claim 28, wherein the medial leg and the lateral leg together underlie a significant portion of the wearer's midfoot and forefoot when the article of footwear is worn, and wherein a first portion of the lateral leg is sized and shaped to receive a second portion of the medial leg that extends across a longitudinal centerline of the support plate, towards a lateral edge of the support plate.

49. The article of footwear according to claim 28, wherein the arch support portion is arched away from the anterior and posterior ends of the support plate such that it has a concave configuration relative to the outsole and extends in a different plane than the anterior and posterior ends of the support plate, and wherein the arch support portion is curved to conform to the arch of the wearer's foot when the article of footwear is worn.

* * * * *